US009208647B2

(12) United States Patent
Ulrich et al.

(10) Patent No.: US 9,208,647 B2
(45) Date of Patent: Dec. 8, 2015

(54) SCALABLE AUTOMATED REAL-TIME MANAGEMENT OF PEER-TO-PEER WAGERS BASED ON EVENTS OCCURRING DURING EXTERNAL CONTEXTS

(71) Applicant: BALLCRAPS LLC, Hoboken, NJ (US)

(72) Inventors: Matthew Ulrich, Hoboken, NJ (US); Robert Allison, Hoboken, NJ (US); Apu Shah, Jersey City, NJ (US); Joseph Kimmel, Brooklyn, NY (US); Micah Nickerson, Brooklyn, NY (US)

(73) Assignee: BALLCRAPS LLC, Hoboken, NJ (US)

( * ) Notice: Subject to any disclaimer, the term of this patent is extended or adjusted under 35 U.S.C. 154(b) by 77 days.

(21) Appl. No.: 14/017,395

(22) Filed: Sep. 4, 2013

(65) Prior Publication Data

US 2014/0274321 A1 Sep. 18, 2014

Related U.S. Application Data

(60) Provisional application No. 61/789,012, filed on Mar. 15, 2013.

(51) Int. Cl.
*G07F 17/32* (2006.01)

(52) U.S. Cl.
CPC ..... *G07F 17/3244* (2013.01); *G07F 17/3272* (2013.01); *G07F 17/3288* (2013.01)

(58) Field of Classification Search
USPC ..... 463/25, 29
See application file for complete search history.

(56) References Cited

U.S. PATENT DOCUMENTS

| | | | | |
|---|---|---|---|---|
| 8,585,502 | B2 * | 11/2013 | Shepherd | G07F 17/32 463/19 |
| 2010/0113139 | A1 * | 5/2010 | Shepherd | G07F 17/32 463/25 |
| 2011/0081955 | A1 * | 4/2011 | Lange | G06Q 40/04 463/6 |

* cited by examiner

*Primary Examiner* — Pierre E Elisca
(74) *Attorney, Agent, or Firm* — Gottlieb Rackman & Reisman P.C.

(57) ABSTRACT

An internet based automated wagering system allows many participant to wager on outcomes of certain events associated with a game. The wagering can occur in real time or can be delayed. Presentations are made to participants indicating various events associated with the game and participants can then send to the system proposed wagers based on possible outcomes of the event as selected by each participant. The system then finds a partner for each participant and an engagement is established between the participants interested in the same wager and event outcome. The system can monitor events and determine their outcomes, or can obtain event outcome information from external sources.

20 Claims, 18 Drawing Sheets

SCALABLE AUTOMATED REAL-TIME MANAGEMENT OF PEER-TO-PEER WAGERS BASED ON EVENTS OCCURRING DURING EXTERNAL CONTEXTS

RELATED APPLICATIONS

This application claims priority to U.S. Provisional application Ser. No. 61/789,012 filed Mar. 15, 2013, incorporated herein by reference in its entirety.

BACKGROUND OF THE INVENTION

A. Field of the Invention

This application relates generally to wagering on external contexts such as sporting events, and more particularly to managing high volumes of peer-to-peer wagers placed on actions or results occurring during an external context as it transpires in real time.

B. Description of the Prior Art

Wagering on external contexts such as sporting events is an age-old tradition that can be traced back to the first Olympic Games in Greece, if not to the first time two men engaged each other in a foot race or some other test of strength or skill. People continue to place wagers on virtually any external context known to man. This can range from outcomes of organized sporting events such as basketball, football, hockey and baseball games, to races between people, horses, dogs and automobiles, to which one of a flock of pigeons will fly away first.

Wagering on the outcome of sporting events (typically winners and losers based on the score of the event) and races (typically based on who finished first and/or the order in which the participants finished) has been big business for a very long time. More recently, providing the ability for participants to do so on-line is fast becoming the preferred mode of engaging in such transactions. The market for these wagers is typically provided by a business known as a sports book. The sports book provides odds as to the likely outcome and accepts wagers on all outcomes, with the odds set by a central odds-maker to ensure that the sports book will make a profit regardless of the outcome.

Other types of wagers may also be offered for these external contexts, including wagers known as proposition (i.e. "prop") bets. Prop bets are not limited to the actual outcome of the game (i.e. the winner and loser). Rather, prop bets can be made concerning certain statistical features of the game, such as whether the total number of points scored between the two teams is over or under some predetermined total score (sometimes referred to as an "over/under"). Another example of such a bet could be, within the context of a football game, based upon an/over under regarding how many total yards of offense will be gained by one or both teams, or how many total sacks will be given up by one or both teams. An example of a non-statistical prop bet might be placed regarding which player will be named to receive the "Most Valuable Player" (MVP) award, or whether there will be a wardrobe malfunction during the half-time show.

Traditionally, these bets must be transacted before the game starts, after which betting is typically closed. The outcomes of these wagers are then evaluated to determine winners and losers as soon as the event horizon or time-line for the wager closes. In the case of a wager on the outcome of the game, or the over-under on total points scored, the event horizon originates with the opening kickoff, will extend to and terminate at the end of the game. In the case of which player wins the MVP award, the event horizon or time-line for the wager will extend until the winner is announced by the voters for the award. In some cases, halftime bets may permitted, in which case the opportunity to bet will be run throughout the halftime break of the sporting event such as a football game, and will close when the game resumes. In addition, the odds will most likely be re-calculated based on the actions that have already transpired during the first half of the game.

Recently, some on-line sports books have begun to offer "in-game" wagering, where a sports book continues to re-calculate and update the odds of the outcome of a game as the game is played, allowing a participant to bet on the outcome while the game is in progress. Some other variations of real-time in-game betting have been offered, wherein for example, the participant can bet on the result of a half, period or some other fraction of the game (e.g. the first ten minutes) rather than on the entire game. Typically, these wagers must be made prior to the triggering of the wager's time-line (e.g. before the period during which the predicted actions or context are to occur or not). The types of in-game actions upon which wagers may be placed, however, have been heretofore significantly limited due to the complexity of managing such wagers. These include the constant updating of the odds and the large number of users that may wish to participate, particularly in an on-line context.

Less structured, but likely more prevalent, are peer-to-peer wagers that are made between two or more individuals. In this case, a first individual proposes a wager specifying context conditions regarding the occurrence or non-occurrence of a possible action, or a series of such actions that may occur as the external context transpires (e.g. as the game is played). The proposing individual provides the market for that wager by offering odds as to the likelihood that such context conditions will be met and puts up the money to ensure a payoff to an acceptor in the event that the proposed context conditions of the wager are fact met. In this case, the individual offering the market for the wager invites one or more other individuals to accept the wager. An acceptor chooses to accept the proffered basis for the wager and agrees to the proposed odds that will determine the accepting individual's payout should he or she win. Typically, the acceptor also puts up the value of the wager to the proposer, so that the funds are available to pay the proposer should the proposer win.

Heretofore, peer-to-peer wagering has typically transpired between friends, or among small groups of people. Such wagers can be proposed and accepted well prior to the onset of the external context, such as the Superbowl, or might occur anytime, even during the game. If the proposed wager is made where the specified condition for the wager concerns the outcome of the game, the wager is usually required to be accepted prior to the onset of the game (i.e. this is the onset of the event horizon for the wager). However, because a few individuals can more easily process such transactions amongst themselves while observing actions of the game transpire in real time, proposed wagers might even be for a more granular level of actions that occur as the external context plays out. In the case of a football game, for example, wagers between peers can be quickly proposed and accepted in real time concerning actions such as whether the next play will be a pass or a run, whether the current drive will result in a touchdown, a field goal or a turnover, or whether the next punt will be returned or fair caught.

Naturally such real-time wagering, even among a few individuals watching a game together and handling their own transactions, must be significantly limited in number and granularity, or the group will soon encounter snags in processing them all. As the external context unfolds and the event horizons for the actions and upon which wagers are made are triggered and/or completed, the individual outcomes of each action or series of actions for each transaction must be evaluated in real time to determine whether the specified conditions were met. This evaluation can be complicated when the apparent outcome of certain actions may not actually be permanent because, for example, a penalty or a replay reversal has wiped out the results of a previous play. In this case, the outcome of a play must be undone, and the conditions of the wager re-evaluated for a new play.

While a few sports books do currently facilitate in-game betting through a web site on-line, such wagering is severely limited as to the types of wagers that can be made. They are typically limited to betting on the outcome of the game as it progresses, or wagering on the outcome of fractions of the game, such as quarters, periods or halves. Beyond these simple types of in-game wagers, it is virtually impossible for a sports book to handle more. The sheer complexity involved in processing such wagers in real time as events of the game (external context) unfold, as well as to centrally set and maintain odds for all of these possible actions that could occur at any time during an external context such as a sporting event. The complexity of managing such transactions increases exponentially as the number of participants becomes large, as would be expected when offering such wagering opportunities in an on-line context.

SUMMARY OF THE INVENTION

LEXICON: The various terms used in the present application are hereby defined as follows:

External Context; Game: "External Context" and "Game" are used interchangeably to indicate the context that participants wager on.

Participant: A Participant is a user of the system who interacts with the system through a User Interface and makes wagers against other participants.

Table: A table is an environment where a finite number of participants make wagers against each other regarding a specific external context.

Context Data: "Context Data" refers to the discrete data that describe a Game; these data are used to evaluate engagements and update GameInfo.

GameEvent: Context Actions; Actions: "GameEvent," "Actions," and "Context Actions" collectively refer to actions or events that occur in the External Context.

GameInfo: GameInfo refers to the current state of the External Context.

Context Conditions: Context Conditions refer to the specific context actions upon which a wager is made.

Event Horizon: The Event Horizon is the horizon during which the context condition is proposed to occur for a specific wager.

Proposal: A proposal is a wager proposed by a participant, comprised of a specific set of context condition(s), event horizon, value, and odds. The proposal is considered "open" until it is accepted or matched by another participant. When it is accepted, it is considered "closed" and is then considered an "Engagement."

Engagement: An engagement is a wager where two participants have agreed to wager on a specific proposal.

Value: The Value refers to the amount wagered for a specific proposal/engagement.

Odds Modifiers: The Odds refers to the odds attached to a specific proposal/engagement.

Acceptance: "Acceptance" is the term used to describe a participant's action when accepting a different participant's proposal, thereby creating an engagement.

Evaluation: "Evaluation" refers to the action the system takes when it is determined that an engagement needs to be paid out to the winning participant.

Table Delay: "Table Delay" refers to the delay of all GameEvents for an entire table, allowing all participants of a particular table to view the GameInfo, make proposals, and create engagements, with a consistent delay.

Participant Delay: "Participant Delay" refers to the further delay of GameInfo for a specific participant, who may be viewing the game on a different small delay than other participants of the table.

Rollback: "Rollback" refers to the functionality of rolling back already disseminated gameEvents and associated actions such as evaluation of engagements.

Briefly, a wagering system constructed in accordance with this invention is provided for receiving a plurality of wagers from a plurality of participants related to a specific game. Each wager defines an engagement between at least two participants dependent on an outcome of one or more events. The system includes a participant manager module adapted to monitor activities of all participants and engagements associated with said specific game; an event manager module adapted to monitor all the events associated with the specific game and providing alert signals indicative of at least one of the beginning of each event, the end of each event and actions occurring during each event; a presentation interface module interfacing with participant, said presentation interface module receiving commands from participants regarding events that each participant wants to wager on and providing participants with presentations indicative of said specific game together with said events and wagering information associated with the events, commands from the participant being associated with respective engagements between participants and providing information indicative of participants' engagements to said participant manager; and a wagering engine associated with said participant manager and said events manager and generating current wagering information reflecting wagers made by participants and engagements won and lost by participants as the events of the specific games progress and eventually close.

The system functions by receiving during a game a wager from a first participant with a specific value and odds, based on an outcome of a specified event. The system looks for at least another participant who accepts the proposed wager and an engagement is set up between the first and another participant. The system then monitors the event and determines the outcome relevant to the engagement.

In one embodiment, depending on the event and the capabilities of the system, the system monitors the outcome of each event and sends the various outcomes to a Participant Manager that manages the wagering between the participants. In another embodiment, information about an event is obtained from an outside event monitoring system.

In some cases, after an event is completed, its outcome may be changed or modified. In such cases, the engagement between participants is rolled back to reflect the changed or modified outcome of the event.

In some cases all wagering takes place in real time while an event is happening. In other cases, wagering occurs after a specific delay. In such cases, the events are held for delayed processing.

BRIEF DESCRIPTION OF THE DRAWINGS

The following description can be better understood in light of Figures, in which.

DETAILED DESCRIPTION OF THE PREFERRED EMBODIMENT

Figure 1:
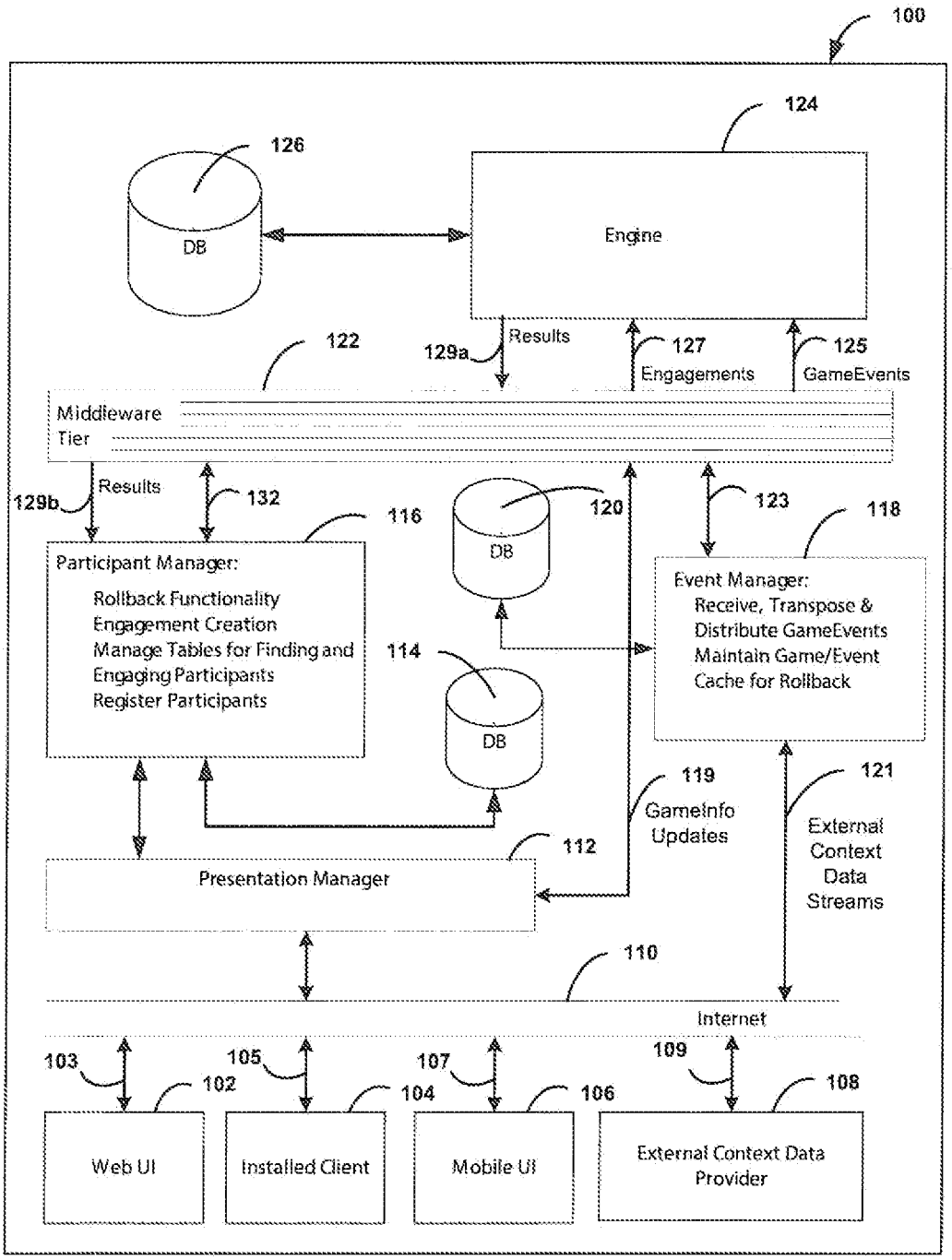
FIG. 1 is a block-diagram of an embodiment of the wager management and processing system of the invention.

The present invention is a scalable system for managing and processing wagers between virtually any number of participants, with regard to virtually any number of live external contexts or events (e.g. sporting events such as football, baseball, basketball and hockey games, horse and car races, soccer matches, and the like), that can provide possible occurrences of actions over which wagers can be made. The wagers can be based upon virtually any number of actions (or combination or sequence of actions) that have some probability of occurring in the course of such events. For example, in (American) football games, the wagers can be made based on the occurrence (or the failure of the occurrence) of touchdowns (TDs), fumbles, first downs, sacks, running plays, passing plays, interceptions, etc. In baseball games, wagers can be made on the occurrence (or the failure of the occurrence) of home runs, stolen bases, doubles, strikeouts, wild pitches, etc. For horse races, wagers can be placed on specified horses to win, place, show, or to lead the race after some fraction of the race has completed. For auto races, wagers can be made on the occurrence (or the failure of the occurrence) of accidents, penalties, pit stop times, lap times, leaders, order of completion, etc.

These wagers, once proposed and accepted between participants, will be referred to hereinafter as engagements. The engagements managed by the system can be based on peer-to-peer wagers between individuals, where individual participants can propose and provide the market for the wagers and other participants can accept those wagers. The system can also manage engagements that are wagers between an entity, such as a sports book, and individuals, where either party can provide the market.

In one embodiment of the invention, participants observe the external context, such as a live (albeit slightly delayed through the latency of transmission) video feed of a sporting event. Each participant can propose terms for an engagement (i.e. a proposal), as well as to actively accept proposals (an acceptance) for engagements proposed by others, the engagements evaluated based on the actual actions generated as the sporting event transpires. The participant who creates and submits a proposal for an engagement is hereinafter referred to as the proposer for that engagement, and the participant who accepts a proposal by which an engagement is created is hereinafter referred to as an acceptor for that engagement.

In some embodiments of the invention, individual proposals made by two participants can themselves be matched to create engagements. Such engagements are deemed to match where the terms of the two proposals are, in essence, tantamount to a proposal and an acceptance of the proposal. An example of such a match can occur where one participant proposes a wager that the next play in a football game will be a run, whereas another participant proposes a wager that the next play of the game will be a passing play. Another example of matching proposals is where one participant proposes that a first down will be achieved during the current drive, and a second participant proposes that no first downs will be achieved during the current drive. Whether two proposals are deemed to be matched in this way to create an engagement can be dictated by house rules that determine what constitutes a match between proposals.

In an embodiment of the invention, the proposals for engagements are based upon actions that have some probability of ensuing during the transpiration of the external context, as well as specified event horizons during which the actions must take place. Context actions are typically acts performed by those involved with the external context, such as runs, passes, kicks, catches, shots, etc. Alternatively, the context actions could be specific results of those acts, such as a completed pass in football.

Event horizons are time-lines that are often dictated by the nature of the external context, such as quarters, halves, and other periods of the game, or the manner in which the game is played, such the finite plays of football versus the continuing action of a soccer match. Thus, in a soccer match, for example, more granular event horizons might be defined such as by possessions of the ball, rather than discrete plays that occur in football and baseball. Event horizons may even be specified to span beyond the actual start time or end time of a game that serves as an external context. Such a time-line might be appropriate for an over/under wager regarding how long the singing of the Star Spangled Banner will last, which occurs before the sporting event itself even begins.

Participants construct proposals by specifying a set of one or more context conditions. The context conditions specify the occurrence or non-occurrence of a context action and the event horizon or time-line during which the context action must occur or not occur. The proposal also specifies the odds being proposed. The proposal further specifies a value that, in conjunction with the specified odds, forms the basis for the payoff that will ensure to the winning participant of the engagement. The winner is determined based upon an evaluation of the engagement in view of GameEvents that occur as the game transpires, a process that is triggered when the GameEvents received from the external context satisfy the context conditions specified by the engagement (i.e. the specified context action occurs, or fails to occur, within the specified event horizon).

Rules are generally specified for, and enforced by, the system of the invention regarding the time frame in which such proposals may be submitted and accepted during transpiration of the external context. Such rules will often depend upon the type of external context providing the actions that are being wagered upon. For example, a proposed engagement that specifies a context condition that the next play in a football game will be a run, must be accepted prior to the onset of the time-line for that proposed engagement, which is the snap of the ball for the next play.

The context conditions for an engagement can be based on the occurrence (or non-occurrence) of a single action (i.e. GameEvent) taking place within the external context. For example, the occurrence of a single context action for an external context such as a football game, can be that the next play (the event horizon) will be a running play (context action). An example of the occurrence of a single context action for a football game that is specified as part of the context condition for an engagement can be that a touchdown (context action) will NOT be scored during the current possession or drive (the event horizon). Proposals can also specify a single transaction that is made up of a combination of multiple context actions. An example of such a proposal specifies that the next play will be a pass AND it will result in a TD.

Context conditions for an engagement can also be defined as the occurrence (or non-occurrence) of a series or sequence of such context conditions in a specified order appropriate to the external context upon which the engagement is based. In this type of proposal, the engagement can be thought of as being structured upon the success or failure of multiple single context conditions, each occurring within their own defined time-line (e.g. the next play). For example, a series of context actions of a football game, specified as part of a context condition of an engagement, could be that the next three plays will be running plays. Thus, if the next play is in fact a running play as indicated by a received GameEvent, the context condition of the engagement will now be satisfied if the next two plays are runs. This process continues until the context condition becomes "the next play is a run." If at any time during the consecutive "next play" time-lines, a pass play is executed instead, the context condition for the overall engagement fails and the evaluation of the engagement is triggered. Another example for a context condition being met over consecutive event horizons is a proposal that the next two plays will be a run, followed by a pass play.

The context conditions can also be defined as a certain total or accumulated number of occurrences of a context action or context event within the event horizon. For example, the context conditions might be specified such that a certain number of points or touchdowns will be scored by both teams over some predetermined value, as in an "over-under" type wager. The context conditions can also specify a logical combination of two unrelated context actions. For example, where the external context is a baseball game, the context conditions for an engagement could be that at least one run will score and at least one base will be stolen during the next inning.

As will be clear to those of skill in the art, the type of context conditions that can be specified for any given external context are myriad, and will clearly vary depending upon the nature of the external context. Those of skill in the art will understand that while most examples of context conditions provided throughout this section are for football games, embodiments of the system of the invention will be general enough to manage and process virtually all types of context conditions for virtually all types of external contexts.

The event horizon of an engagement is an explicitly defined time-line for the life of the engagement. The start and endpoints of event horizons can be defined in terms of context actions occurring within the external context. The starting point of the event horizon can be as soon as the engagement is closed (e.g. that a fumble will occur sometime during the current drive of a football game). The starting point for an event horizon can also be defined by some predefined point in the future (e.g. the start of the second half of a football game), or by the possible occurrence of some context event or action that may occur in the future during transpiration of the external context (e.g. the beginning of the next drive for the home football team occurring on a change of possession). Evaluation of an engagement can be triggered whenever the specified action, as represented by one or more GameEvents that describes the external context as it transpires, occurs during the event horizon, or fails to occur before the end of the event horizon, if the event horizon was to be triggered by some possible future condition that never occurs, the engagement is considered to have expired and the engagement is evaluated at that time.

The value of an engagement is also specified by the proposer of the engagement. The value of the engagement to the acceptor may be different if the proposer also specifies an odds modifier. The modified value to the acceptor is equal to the proposer's value modified by the odds modifier specified for the engagement. The odds modifier will adjust the expected return for all acceptors of the engagement. Odds modifiers can be even (e.g. 1:1), such that for every unit of value proposed by the proposer, an acceptor's value is also one unit of value. Odds modifiers can also be in the favor of the proposer (e.g. 1:2), such that for every unit of value proposed by the proposer, an acceptor's value is two units. Of course, odds modifiers can also be to the detriment of the proposer (e.g. 3:1), such that for every three units proposed, an acceptor's value for the engagement is one unit. Those of skill in the art will recognize that the odds modifier can be presented or described in the UI in a variety of ways, such as fractional, decimal, moneyline, probability, etc. Although the odds modifier is maintained in relation to the proposal, its display can be from the point of view of each participant.

The system of the invention processes engagements based on a number of defined states. When an engagement is proposed, it is considered to be in an open state. When accepting an engagement, an acceptor can accept all of the proposed value of the engagement as modified by the odds modifier, or any portion thereof. When an acceptor accepts the entire proposed value, the engagement is created for the full proposed value and is then transitioned to a closed state. If the proposed value is not fully accepted by one acceptor, an engagement for the accepted portion of the proposed value is created and closed, and a new proposal (a remainder proposal) for the remainder of the originally proposed value is then created as a new open engagement. This process will occur as many times as necessary until the entire originally proposed value has been accepted, or the time allowed for accepting the proposal has passed.

The system broadcasts the closed engagements to listening engine resources of the system. The engine resources monitor incoming GameEvent data from the appropriate external context by which to evaluate each closed engagement in conjunction with its specified context conditions. Evaluation of each engagement is triggered whenever 1) its specified context condition has been met; 2) whenever it becomes impossible for the context condition to be met; and 3) at the expiration of the engagement's specified event horizon.

Upon completion of the evaluation process, the system of the invention moves the evaluated engagement to a fulfilled state by awarding and paying the closed value to the winner of the engagement as was determined by the evaluation process. Whenever it becomes impossible for the context conditions to be met (i.e. the beginning of the event horizon is never triggered), the engagement is evaluated to be a push and the respective values are returned back to the proposer and acceptor.

In an embodiment, distinct groups of participants (hereinafter called "tables") can be maintained to provide private environments (i.e. tables) for groups of friends. Participants can be authenticated through third-party social networking services, such as FACEBOOK, to facilitate finding friends and providing "real" participant information, such as user name and photo or avatar. Those of skill in the art will recognize that further event publication can be managed across any of the connected third party services. Furthermore, chat and other social interactions are permitted.

In an embodiment, the system can provide a facility to allow users to save proposals or proposal strategies. For example, the system could allow a participant to indicate that he would like to propose a touchdown with 1:1 odds whenever the home team advances past the 50 yard line. Alternatively, the system could allow a participant to compose a custom proposal and save it for future use, such as, for the sport of baseball, no runs scored AND at least one runner stranded in the current inning.

In some embodiments, special proposals can be provided for participants. For example, one of these special proposals can be a proposal sent to another specific participant; this challenge would alert the other participant, and would allow for a bonus or larger value. Another special proposal would allow a participant to "guarantee" a specific context condition and accept all outstanding proposals, and lock that context condition with a pre-determined odds modifier, so that all other participants could not offer better odds. Another special proposal would allow a participant to force an alert to all other participants to make it more apparent to them. Each of these special proposals could be limited so that each participant can only use a certain amount per game, or otherwise would need to purchase additional.

In an embodiment, the system can allow for optional time delays to account for different broadcast latency delays; satellite broadcast is typically delayed several seconds behind terrestrial or cable broadcasts. This allows for participants to use the system while watching the external context without the system's gameEvent broadcast being seen ahead of the broadcast that the participant is viewing. This time delay can be set alternatively per user or per table. Setting a time delay for a private table would be useful for a group of participants who are watching the external context on the same broadcast. When this is set per table, the broadcast of events and all related time-based thresholds are delayed. On the other hand, when the time delay is set per user, the gameEvent broadcast is delayed to that user, but the other time-based thresholds, such as when the participants are permitted to accept proposals, are not delayed; this allows for fair rules for all participants.

Those of skill in the art will recognize that by providing a scalable infrastructure by which to propose, execute and manage such engagements to fulfillment, the system of the invention permits virtually any number of participants to successfully propose and accept a virtually limitless number and combination of engagements, in real time, throughout the duration of a large number of external contexts such as sporting events, races, contests or any other external context for which particular context actions may predictably occur as the context transpires in real time.

To accomplish the foregoing, embodiments of the system of the invention include a number of scalable resource components, each dedicated to the performance of the various sub-tasks necessary to successfully facilitate and manage the creation and management of such a large number of disparate types of wagering transactions on an endless number of external actions from any number of external contexts, and among a virtually limitless number of participants.

FIG. 1 is a functional block level illustration of the major components of an embodiment of the system 100 of the invention. The system 100 of the invention provides one or more user interfaces (UI) 102, 104, 106 by which participants can interact with the system. One embodiment of a UI of the system 100 can be a web-based interface 102 that is coupled with the Internet 110 through appropriate Internet connection 103, and through which a participant may interface with other elements of the system 100 through a typical web browser program stored on an end user device such as, for example, a personal computer (not shown). Another embodiment of a UI of the system 100 can be an installed client-based interface 104 by which a direct connection to other elements of the system 100 is facilitated over the Internet 110 through Internet connection 105. Still another embodiment of the UI can be a mobile based interface 106 that permits interaction over the Internet 110 through Internet connection 107 using, for example, a mobile end user device such as a smart-phone or a tablet device.

Each of the various embodiments of a UI enables a user to register as a participant, as well as to identify and choose an existing environment (hereinafter referred to as a "table") or to create one in which to become a participant. The table is essentially the virtual equivalent of a table at which the participant is currently wagering with other participants. In an embodiment, a table is associated with one external context such as a particular sporting event, as well as a particular group of one or more participants with whom a user participates to establish engagements regarding the associated external context. Each of the embodiments of the UI enables a participant to build and submit proposed engagements concerning the associated external context to other participants of the table, as well as to accept proposed engagements proposed by other participants of table concerning the external context. Participants may join more than one table at any given time, each table being associated with the same or a different external context.

Each of the embodiments of a UI further provides the participant with the ability to follow the pertinent context actions generated by the external context associated with each table, as the external context unfolds in real time. This GameInfo is provided to the UI of the participant through the Presentation Manager 112 preferably implemented as an API. Additionally, graphic interfaces that facilitate the submission and acceptance of proposals, as well as graphics depicting the acceptance, evaluation and fulfillment of engagements, are also provided for display on the participants' UI. Finally, embodiments of the UI provide the participant with the ability to view and manage his or her own account, including winnings and losses.

Those of skill in the art will recognize that the foregoing recited functions of various embodiments of the UI are not intended to be exhaustive, and other functions common to UI configurations may also be performed to provide necessary interaction with the system 100. A more detailed description of various embodiments of the UI will be provided below.

Participant Manager 116 is communicatively coupled through the Presentation Manager 112 to the various UIs 102, 104, 106, and is responsible for handling all user actions interactions with the system 100 of the invention. These functions include registering participants and maintaining their accounts, creating new tables for those participants, managing existing tables and helping users to find and engage with other participants. Participant Manager 116 is further responsible for the establishment and management of engagements created between participants. This includes facilitating the creation, submission and maintenance of proposals created by participants through the UI, as well as the processing of acceptances of particular proposals received from participants through the UI to create closed engagements. Participant Manager 116 also creates closed engagements through the matching of proposals that can be treated as a mutual acceptance of the two proposals. Finally, Participant Manager 116 manages timing issues regarding when proposals may be accepted, and when the creation of engagements must be suspended because an event horizon has already begun.

Embodiments of the Participant Manager 116 can include configurable "house rules" game logic that will dictate the criteria required for two proposals to be considered matching for purposes of creating an engagement. One example of such a configurable rule establishes two proposals as matching for purposes of creating an engagement only when those proposals have perfectly matching terms (i.e. the context conditions, the event horizon, the value and the odds are all identical) will two proposals be considered matching for purposes of creating an engagement. Another less strict rule would find two proposals matching if the triggering condition(s) (i.e. the context action(s) and the event horizon in which they must occur or not occur to trigger an evaluation) are identical, even though the value and odds of the proposals aren't perfectly matched. In this case, the odds can be deemed to favor the higher risk participant or Proposer. A third possible rule might be configured to match proposals that involve logical crosses (i.e. the proposals are completely different with respect to triggering conditions, but they logically cancel each other out within the game). An example of such proposals would be if, in a football game for example, where the down and distance is 3rd & 3, a proposal is made "for a first down" to be achieved on the next play. This proposal can logically cross with a proposal that is "against gaining 3 yards"). Those of skill in the art will recognize that other such configurable rules by which to match proposals are possible without exceeding the scope of the intended invention.

The Participant Manager 116 further communicates the status of a participant's proposals, acceptances and closed engagements as they are processed by broadcasting them to the appropriate (i.e. "listening") Presentation Manager 112 resources. This includes informing the participant of when a proposed engagement is accepted and by whom, when a participant's acceptance leads to an engagement and with whom, and the results of the engagement once evaluated and fulfilled. Participant manager 116 also dispatches closed engagements by broadcasting them to the appropriate (i.e. "listening") Engine 124 resources for monitoring and evaluation, and receives the results of the evaluation for each engagement back from the Engine 124.

In managing the process of creating engagements, the Participant Manager 116 also determines if and when to close the acceptance or auto-matching of existing proposals to create engagements. The system 100 can specify such "CLOSED" periods, based on the type of external context that is providing the external actions forming the basis for the engagements. For example, if the external context is a football game, a closed period is typically established between the snap of the ball (i.e. initiation of a play) and the completion of that play (e.g. when an official blows the play dead). During this closed period, no proposals can be accepted or auto-matched to form new engagements, nor can any established engagements be dispatched to the Engine 124 through Middleware tier 122.

The system 100 may also have a specified "Pending" period which is recognized by the Participant Manager 116. Such pending states are typically applied to sporting events where the action tends to be continuous, such as basketball, soccer and hockey for example. After a proposal is accepted or is auto-matched to another proposal to form an engagement, the engagement is then held in the pending state for some specified time prior to its dispatch to the Engine 124. After a countdown timer for this specified time expires, the engagement is dispatched to the Engine 124 and is queued for evaluation. In an embodiment, the Participant Manager 116 abides by rules that dictate what happens to a pending engagement when a context action occurs that meets the triggering condition of that engagement while it is still in the pending state. In accordance with such rules, the engagement can be canceled or possibly dispatched to the Engine 124 to be evaluated on subsequent context actions which may meet the triggering conditions.

Finally, Participant Manager 116 also handles the rollback of context actions under circumstances where context actions must be rolled back to some previous state. As discussed above, this can occur in circumstances where either a mistake was made in describing the sequence of actions that form the GameEvent stream 121 for the external context of interest (e.g. a mistake was made in keying in the data that is received from the External Context Action Provider 108), or because such actions are rolled back in the game itself. This can happen when, for example, instant replay overturns a touchdown or a completed pass in football, or when a penalty is enforced and therefore negates the action of the previous play. Another example can occur when a previous ruling has been reversed by instant replay, such as a touchdown catch in football, a home run in baseball, or a goal in hockey. In all of these cases, GameEvents have already been received and used to process engagements by the component resources of the system, and thus the processing must be undone and new GameEvents must be generated in accordance with updated results of the previous play or action that have been reversed or altered.

Also coupled to the system 100 of the invention, through the Internet 110, is an External Context Data Provider 108.

This component provides a source of play-by-play description data for each external context that is made available to participants of the system 100. The External Context Data Provider 108 provides a context data stream 121 for each external context. Each context data stream 121 describes the actions as they take place in real time for sporting events, races and other types of external contexts.

The context data streams 121 produced by External Context Data Provider 108 can be generated using play-by-play input created in real time by one or more observers of the game. The observers can key their description of the action of the game into a system that produces the context data stream, or through automated techniques such as voice recognition, that could be applied to the audio feed being generated for the game, in one example. In an embodiment, the External Context Data Provider 108 that generates the context data streams 121 is one that generates the data streams in a format that is readily consumed by the system 100. In this case, the External Context Data Provider 108 generates data in the form of a series of GameEvents that can be used in their generated form by the Engine resources 124 to evaluate pending engagements. Thus, the Event Manager resources coupled to the External Context Data Provider 108 do not have to reformat and normalize the context data streams 121 to produce the GameEvents.

In still another embodiment, one possible source of such play-by-play information can be derived from independent providers that are licensed by the various sports leagues to provide Internet gamecasts of such sporting events. These providers, such as STATS LLC, generate a webcasted data stream representing play-by-play information for each game as it transpires. These webcasts are capable of being received by computers and mobile devices of users over the Internet, and can be received by system 100 over Internet connection 109. These providers currently produce data-streams for sporting events such as baseball, football, hockey, and basketball games, and can also include statistics for each game that are updated in real time. Because these sources typically have their own format, the Event Manager 118 is capable of converting the play-by-play information format as received from such independent providers to a series of GameEvent data messages that an Engine 124 resource compares with context conditions specified for engagements in performing its evaluation of such engagements.

If an external provider is unable to provide the level of granularity required to maintain the state of the game, or is unable to provide a consistent and predictable GameEvent delay, the system can also accept manually entered events. A Game Recorder module allows authorized users to enter the pertinent external context data into the system in the place of an External Context Provider.

For football games, a stream of context actions 121 will typically consist of descriptive information including the nature of each play (e.g. whether it was a running play, a pass play, a punt, a field goal attempt, a kickoff, etc.) as well as the results of the play (e.g. resulting down and distance information, whether a pass was complete, incomplete or intercepted, the number of yards gained or lost on the play, possession maintained, whether a touchdown resulted, etc.). Penalties, which can cancel the results of the play, as well as the results of replay challenges must also be provided to guarantee proper evaluation of the engagements. For baseball games, event/action streams can include the result of every pitch (e.g. balls and strikes, passed balls, hits foul balls, steals, put-outs, errors, runs scored, etc.).

Those of skill in the art will recognize that a single play is often represented in the form of a series of individual GameEvents. For example, a football play may be a pass that produces a gain of a certain number of yards. The gain in yardage then results in a new down and distance, or perhaps even a touchdown and a new score for the game. It could also be followed by a fumble and a change of possession. Such GameEvents are essentially sub-components of the actions of the overall play and presented individually in the interest of keeping the function of engagement evaluation as simple as possible. This process will be demonstrated below as part of a more detailed discussion of the Engine.

Context action data streams 121 for basketball, hockey and soccer games are similar to those of football games, but are more representative of the continuous-action nature of these types of contests, which are characterized by only occasional stoppages in play. Possession of the ball (basketball and soccer) or of the puck (hockey) changes often without any stoppage in play, and as such the time-lines for those contests are a bit less definite, except for the beginning and ending of periods, quarters and halves. Nevertheless, time-lines or event horizons can be established on changes of possessions or on other bases. Those of skill in the art will recognize that the content nature of the stream of actions will be easily determined based on those actions that occur within a particular game on which the participants would want to wager, and the time-line or event horizons appropriate for those wagers.

As shown in FIG. 1, the Event Manager 118 of the system 100 of the invention is coupled to receive context action data streams 121 for a virtually unlimited number of external contexts over the Internet 110. The Event Manager 118 is configured to parse and transpose the content of those data streams into a standard format for processing by the Engine resources 124, if they are not already so formatted. In an embodiment, the context data is parsed into a stream of GameEvents, each GameEvent including a context action that is capable of being used in the evaluation of engagements.

The Event Manager 118 also maintains a cache of GameEvents in database 120 that are gleaned from the data streams for each external context for which a context action data stream 121 data stream is being received. This cache is maintained in the event that an error in the data stream is received, or an error in parsing, extracting and transposing context actions into GameEvents is made, or even an error on the field is made requiring a reversing of a call, all of which can require the reversal of previously evaluated engagements the outcomes for which may now be incorrect as a result. Moreover, such a record of context actions/events can provide the ability to audit the system should there be need to verify the integrity and/or accuracy of the system.

The Event Manager 118 also maintains a sequence of GameInfo data that is derived from the context action data streams 121 to provide a continuous description of the state of the game as it transpires. This GameInfo data is broadcast to the Participant Manager 116 resources and ultimately to participants through Presentation Layer/Manager 112. Presentation Manager 112 creates a displayed update based on the GameInfo, as received through a connection 119 to the Middleware tier, on each participant's end user device. This allows participants to follow along with the external contexts as they transpire. The GameInfo must also be updated appropriately in the event of a rollback as previously discussed. Finally, Event Manager 118 broadcasts each sequence of GameEvents for every external context over Middleware Tier 122 to the system Engine resources 124 for purposes of evaluating those closed engagements that are built on context actions involving those particular external contexts.

In an embodiment, Engine 124, like the Participant Manager 116 and the Event Manager 118, is a distributed resource that can exist as multiple instantiations. Each instantiation of the Engine 124 receives a constant flow of engagements from one or more tables, each of the one or more tables associated with a particular external context. Those engagements broadcast to each instantiation of the Engine 124 originate from a particular instantiation of the Participant Manager 116 managing those particular tables. The Engine 124 is subscribed to the engagements from those particular tables and ignores all of the other engagement traffic broadcast over Middleware Tier 122. The Engine 124 queues its engagements and waits for a trigger to determine which of the queued engagements to evaluate.

Likewise, the instantiation of the Engine 124 also continuously receives a broadcast of GameEvents from the particular instantiation of the Event Manager resources 118 that is handling context data generated from the particular external context for which its subscribed engagements are being made. The Engine 124 uses the GameEvent data to evaluate its subscribed engagements that have been received and queued from the Participant Manager. If the engagements can be evaluated, the Engine 124 broadcasts the result of the evaluation back to the Participant Manager 116 from which the evaluated engagements were broadcast. If they cannot be evaluated based on the GameEvents generated for the particular play, and as long as the time-fine has not expired, engagements are held in the Engine's queue until new GameEvents are received.

The Engine's 124 queue is set up with a plurality of evaluation tiers, each one corresponding to a particular time-line or event horizon. This makes evaluation much faster and more efficient, and permits a high volume of engagements to be handled in real time as the external contexts transpire. Each queued engagement received by an Engine resource 124 is queued into the evaluation tier that corresponds to the event horizon specified by the engagement. Each received GameEvent is used to for evaluating engagements queued in the tier corresponding to its event horizon, as well as for those engagements queued in all evaluation tiers corresponding to a shorter event horizon.

Those of skill in the art will recognize that FIG. 1 is a block diagram representation of a software and computer network system in which the various blocks are essentially software processes that communicate using any one or more known middleware tier communication protocols, such as a distributed cache. Middleware tier protocols typically enable various instantiations of software programs and process components to broadcast messages to each other over a network, each such instantiation of a resource listening for messages from certain other instantiations of other such resources components, while ignoring those that are not intended for them. Thus, each user/participant is communicating through an instantiation of the Participant Manager 116 resource that is listening for message traffic that pertains to the table or tables in which the user is participating. Likewise, each external context is providing a stream of context action data to an instantiation of the Event Manager 118 that is created for processing such data produced for that particular external context. Each instantiation of an Engine 124 resource is listening for Game Events from a particular Event Manager resource 118 and for engagements broadcast by a particular Participant Manager resource 116 that is handling one or more tables wagering on that particular external context.

Middleware Tier 122 is the software component that provides for the distributed communication of engagements and GameEvents to the appropriate Engine 124 resources, as well as to receive and communicate evaluations of the engagement back to the Participant Manager 116. The engagements are broadcast to all instantiations of the Engine 124, and each Engine resource 124 will be subscribed to a subset of all engagement traffic broadcast over Middleware Tier 122. Only one Engine 124 instantiation will be "subscribed" to engagements from a particular table, so that the engagements from a particular table all handled together by the same instantiation of the Engine. An instantiation of Engine 124 may, however, be subscribed to listen for engagements from more than one table, as long as any additional table(s) is (are) associated with the Engine's subscribed external context. As the Engine 124 evaluates engagements based on the received context data, it then broadcasts the results 129*a* of those evaluated engagements, over the Middleware Tier 122, back to the instantiation Participant Manager 116 that is handling the particular table through which the engagement was originally created.

Figure 2:
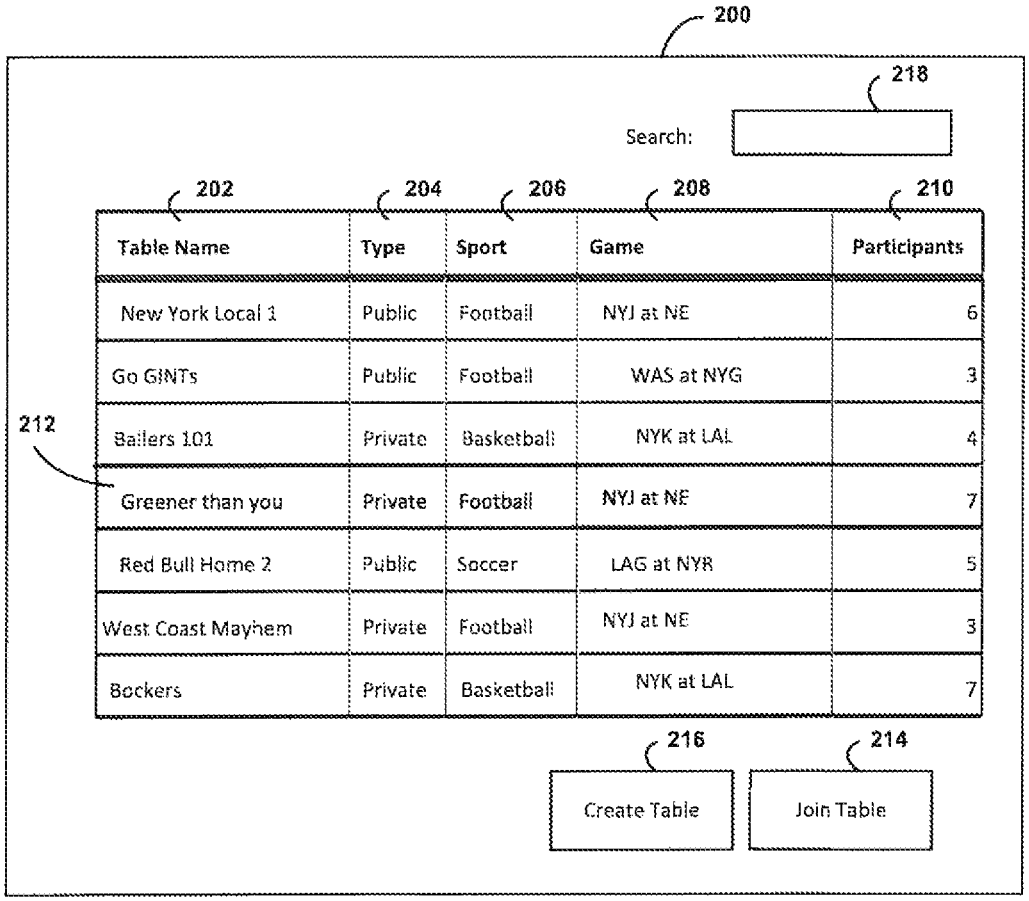
FIG. 2 is an illustration of an embodiment of a User Interface screen of the invention through which a user can choose to join a table in which to participate.

FIG. 2 illustrates an exemplary screen 200 that can be part of any UI employed to provide access to system 100, as well as to facilitate access to (or creation of) a particular table. Screen 200 is referred to hereinafter as the environment screen and displays the tables currently existing on system 100 and labels them as virtual "tables." Each "table" is listed by its name 202, its type 204 (e.g. whether it is public or private), the type of sport 206 that characterizes the external context, the particular sporting event (e.g. game) 208 that provides the external context for that participants of the table, and finally, the total number of participants 210 that are currently participating at the table.

A user can select one of the tables by, for example, clicking or tapping on the row for that table and highlighting it as illustrated by the highlighted listing for table "Greener than you" 212. A user wishing to become a participant of this table can then click on (or otherwise activate) the Join Table button 214. Because table 212 is private, a password request dialog box may then be presented to the user, and the user would then enter the password enabling the user to become a participant at the table 212. If the user wishes to establish his or her own table, the graphical dialog boxes necessary to do so can be initiated by activating the "Create Table" button 216. "Search" box 218 can be employed by the user to enter keywords by which to search for a particular table name or game (i.e. external context), or perhaps all tables the associated external contexts for which are of a certain sport and/or type. Those of skill in the art will understand that Environment Screen 200 is but one of many ways to graphically configure and present such a user interface.

Figure 3:
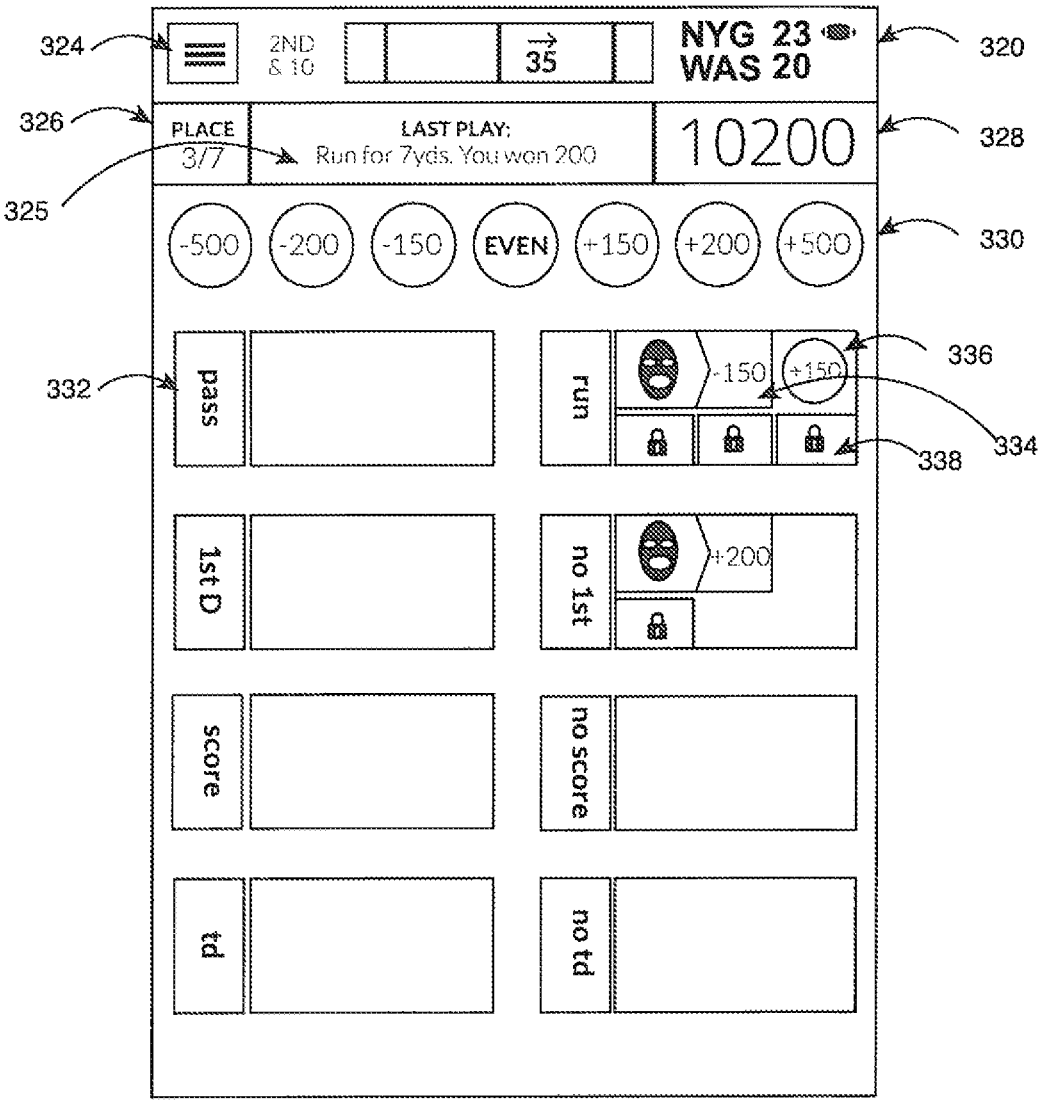
FIG. 3 is an illustration of an embodiment of a User Interface screen of the invention through which a user may view, submit, and accept pre-determined proposals, as well as see a summary of the Game info and status of the table.

Once a user selects a table on the Environment screen, the selected table is initiated as discussed in more detail below; users are afforded the ability to make proposals through any number of different screens. FIG. 3 illustrates a consolidated screen that a user can interact with upon entry into a specific table. A Game Info section 320 displays the current state of the game for the user logged into the table, allowing the user to confirm that the proposals and engagements refer to the same time of the external context (in this example, a football game between NYG and WAS). A navigation menu 324 can be opened that links to other pages such as rules and demo, user maintenance, a score card 238, etc. Another table info section provides information more specific to the user and the table; the user's Rank 326, available funds 328, and a summary of the previous play and results 325 are displayed in this section. In this simplified screen, a finite set of value and odds modifiers are provided in section 330. These are displayed in "Moneyline" terms but could alternatively be displayed with different odds conventions. To make a proposal, the user would be able to drag and drop a specific odds widget to a particular action space 332. In this embodiment, the most popular actions are shown: pass, run, 1st down, no 1st down, score, no score, TD, and no TD. A user's own proposal 336 is shown in the widget until it is matched and a completed engagement is created. The user can cancel this proposal at any time until it is accepted/matched by another participant at the table. Other users' proposals are also displayed on this screen; each action space 332 displays the best available odds from all other users (334); the photo of the user who made the best available proposal is shown to emphasize the social aspect of the game. The odds of the best available proposal 334 are shown from the perspective of the user who would accept them; if the proposer made a proposal for "pass" requesting odds of +150, it would display for all other users in the "run" action space 332 with odds of −150. A user can accept an available proposal by clicking/tapping the available bet 334. When proposals are accepted/matched and engagements are created, they are displayed as locked engagements 338 in the action space 332, and the available bet is removed from all participants' screens. These locked engagements 338 cannot be canceled and will be evaluated when the relevant game event occurs.

Figure 3A:
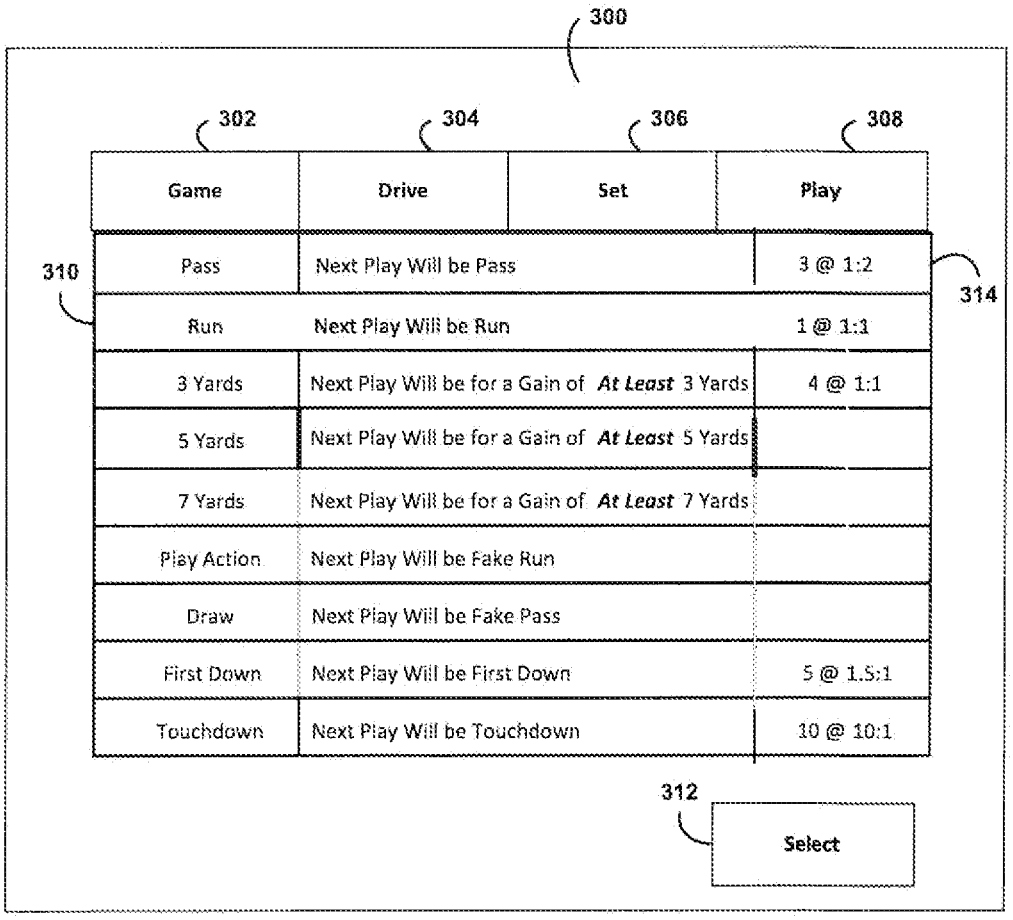
FIG. 3A is an illustration of an embodiment of a User Interface screen of the invention by which a user may choose and submit a proposal from a list of pre-established proposals.

FIG. 3A illustrates a "Common Actions" screen 300 of a UI that lists some or all of the types of single context actions that can be used as the basis of a proposal for the particular type of external context associated with the selected table. The list of context actions is further subdivided based on the type of time-line or event horizon by which the proposals and engagements are constrained. The Common Actions screen 300 of FIG. 3A shows a choice of four possible event horizons for a football game in progress as indicated by data received from the external context from data provider 108. Other users' proposals are shown on this screen, which can be clicked or tapped to accept the proposal and close the engagement. Alternatively, the user can enter a new proposal by clicking or tapping on the "new proposal" buttons. The various event horizons are indicated in a tabular form with tabs "Game" 302, "Drive" 304, "Set" 306 and "Play" 308. The "Play" time-line tab 308 is currently selected and a list of actions that are pertinent to the "Play" event horizon are shown. Those of skill in the art will understand that any number of additional event horizon tabs could be added, such as "1st Half", "2nd Half", "1st Quarter," and so forth, but the embodiments disclosed have been simplified for purposes of clarity. It will be further understood that any number of additional context actions could also be added to the currently selected "Play" time-line, such as "Next Play will be a Turnover," "Next Play will be for a Loss of at least 2 yards," "Next Play will End with a Sack," and so forth.

Figure 3B:
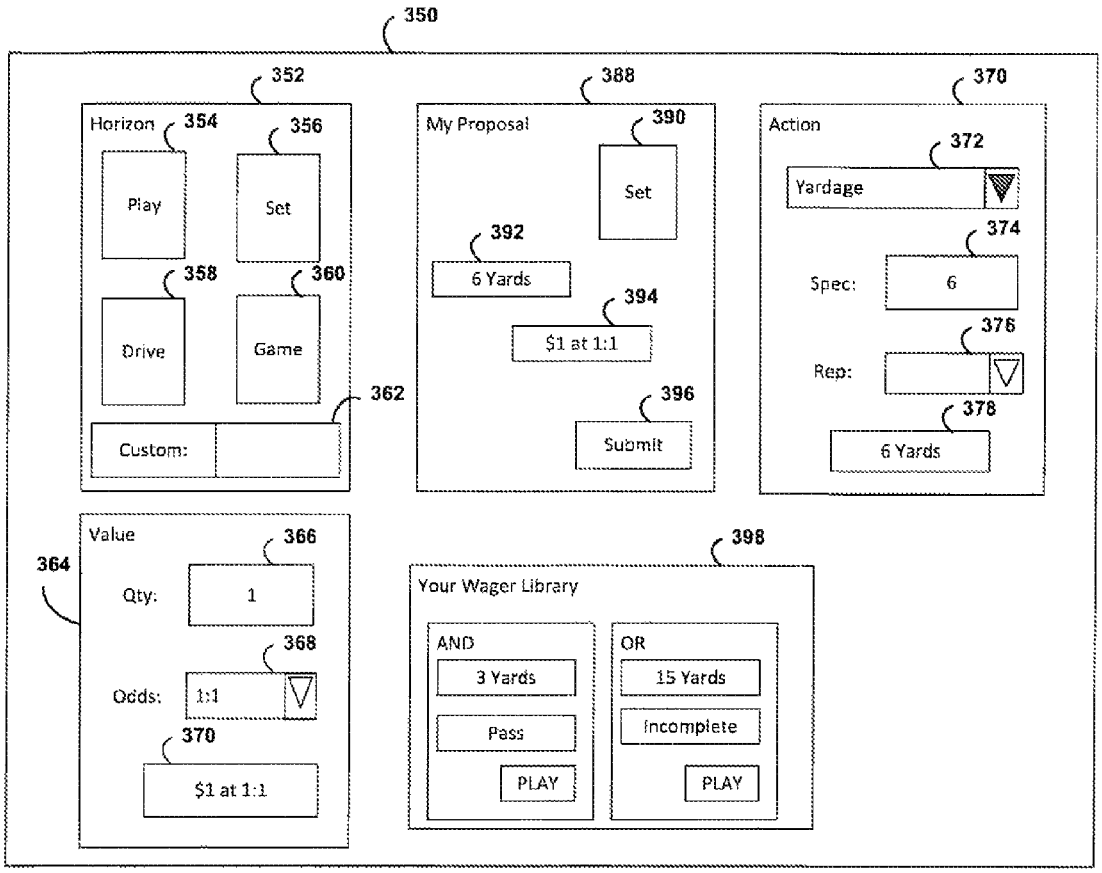
FIG. 3B is an illustration of an embodiment of a User Interface screen of the invention by which a user may build and submit a custom proposal.

FIG. 3B illustrates a more generalized "Proposal Builder" UI screen 350 that permits participants to construct more complex engagements. The screen 350 includes an event horizon section 352 for choosing the time-line for a proposer's engagement. The Event Horizon can be chosen by selecting either the "Game" 360, "Drive" 358, "Set" 356 and "Play" 362, or by providing a custom time-line using text entry 364. Available Context Actions are selected in section 370 by way of drop down menu 372. For actions that require further specific quantities, this quantity is entered in text entry field 374. In this case, "Next Play Will be for at least X yards" is chosen, as shown in text label 378 and 392.

A user can also propose that the action will be repeated a number of times in succession through the "Rep." drop down menu 376. By selecting a number in this dropdown, the user is indicating that the proposal is for the context action to occur in each of the next consecutive event horizons. For example, if "play" is selected as the Event Horizon 352, "Run" is selected as the Context Action 372, and "3" is selected in Rep 376, the proposal is that the next 3 plays will be runs.

The user is afforded the ability to save specific proposals and view them on this screen 398. From here, the user can activate a saved proposal, and after entering the value 364, submit the proposal by selecting the submit button 396.

The user can specify that the proposal is made up of multiple actions, such as the next play is a pass AND more than 3 yards, or the next play is incomplete OR 15 yards. The user specifies these multiple actions by selecting and saving them in the "Your Wager Library" section 398, along with the Boolean (such as AND or OR).

The value of the engagement can be specified through the "Value" section 364 of the UI, by specifying a quantity value (i.e. the amount to wager) through "Qty." text field 366 and an odds modifier (i.e. the proposal's odds) through the "Odds" drop down menu 368. The "My Proposal" section 388 then displays the pertinent context action for the proposed engagement 392, the chosen event horizon 390 along with the value and odds modifier 394. The user can submit this proposal by selecting the Submit button 396.

Figure 3C:
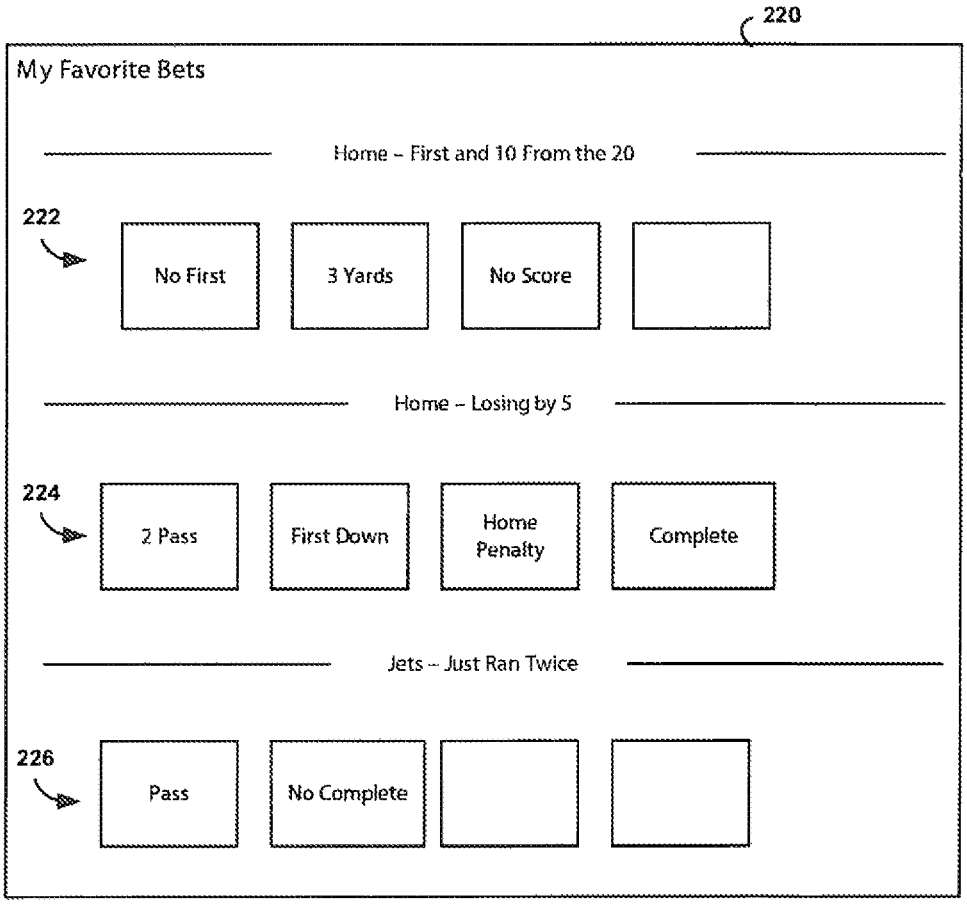
FIG. 3C is an illustration of an embodiment of a User Interface screen of the invention by which a user may choose from a list of favorite proposals.

FIG. 3C illustrates a betting screen 220 that permits a user to pick quickly from a set of wagers that are the user's favorite bets associated with a particular external context such as a football game as illustrated. For example, the user may have a favorite group of bets 222 when the home team has the ball on their own 20 yard line, the down is first down and the distance is 10 yards to go for another first down. In the example, the favorite bets will be that there will be "no first" down, which could have an event horizon of the next play, or the drive; that the next play will gain at least three yards; or there will be no score during the current drive. A second group of bets 224 might be favorites when the home team is losing by 5 points or more. These bets might include, the next two consecutive plays will be passes; that the home team will make a first down during the drive; or that the next play will be a completed pass. A third set of favorite bets 226 might be for a specific team, the Jets, that after they've run on two straight plays, that the next play will be a pass; or that it will be an incomplete pass.

Figure 3D:
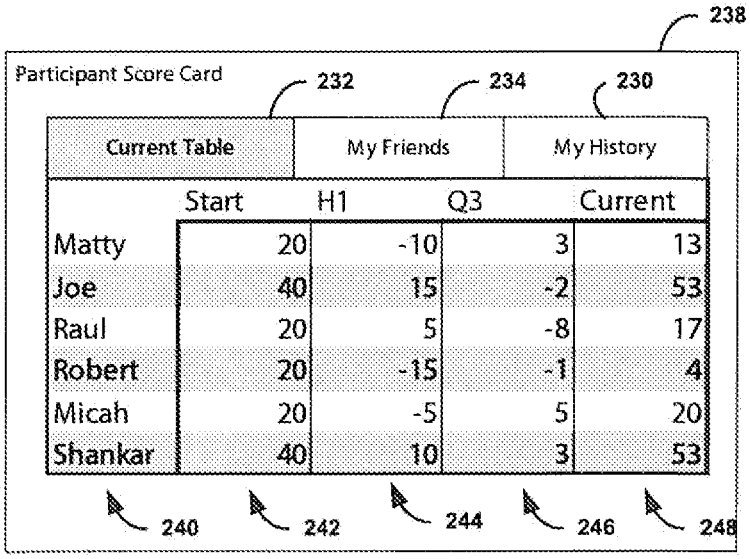
FIG. 3D is an illustration of an embodiment of a User Interface screen of the invention by which a user may monitor the results of his/her participation.

FIG. 3D illustrates a scorecard display 238 by which the user can keep track of the results his or her wagers, as well as those of other participants of interest. As illustrated, there are three tabs that can be accessed by which to access three different views results. The first tab is "current game" tab 232, which illustrates those participants 240 viewing and participating in the current game in which the user is also participating. Along with the names of the participants is 240, their value scores at the start of the game 242, their value scores at halftime 244, their value scores for the third quarter 246 and their current value scores 248 are displayed. Those of skill in the art will recognize that those scores can be credits or currency. Tab 234 can be selected to display the user's friends, perhaps even independent of which game they are participating, and tab 236 can display the user's history alone, either for the current game or perhaps over some extended period of time.

Figure 4A:
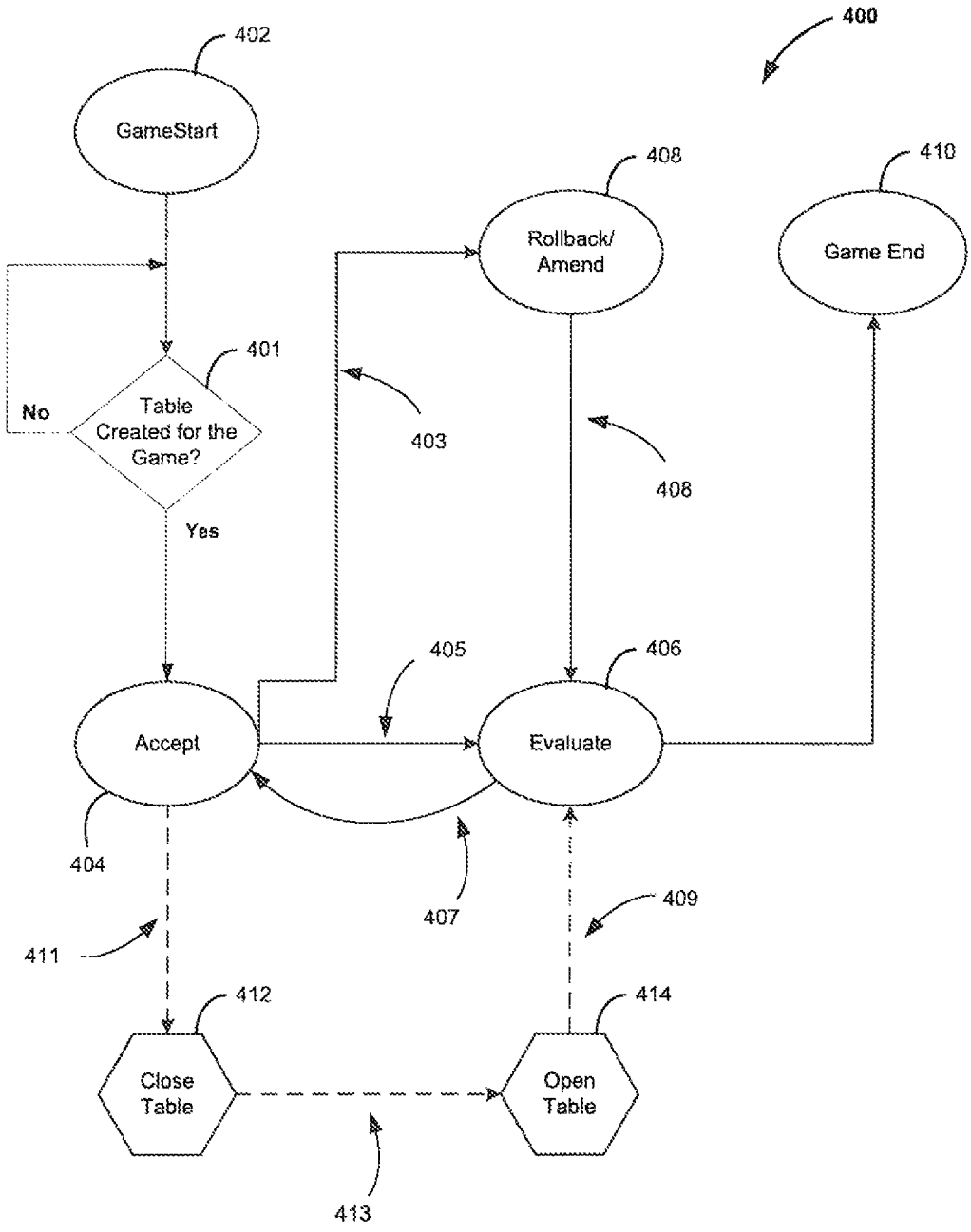
FIG. 4A is an illustration of a general system state diagram or flow chart of an embodiment of the system of the invention.
Figure 4B:
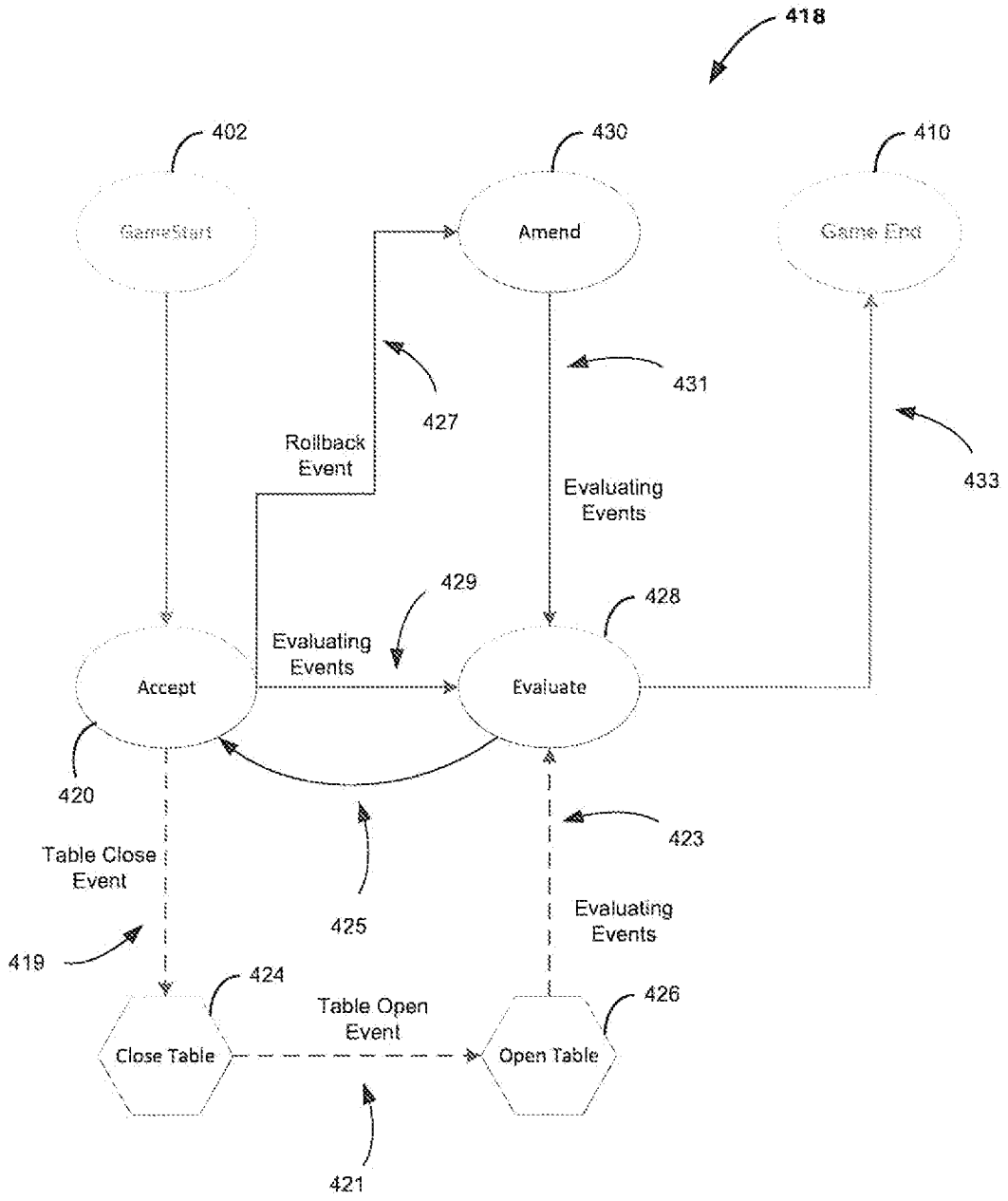
FIG. 4B is an illustration of a general state diagram or flow chart for the Engine resources of an embodiment of the system of the invention.
Figure 4C:
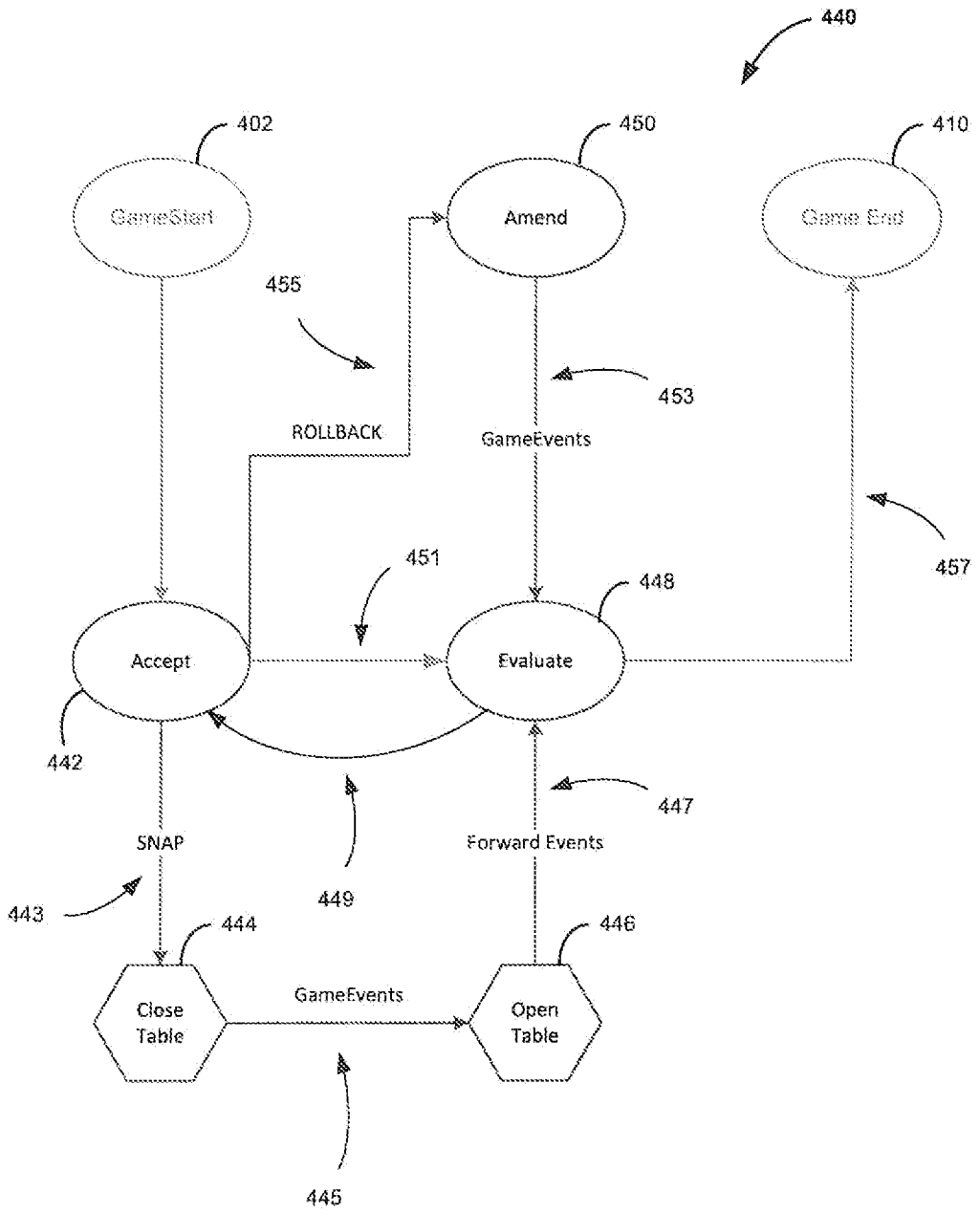
FIG. 4C is an illustration of a state diagram or flow chart for the Engine resources of an embodiment of the system of the invention that is processing wagers on non-continuous action external contexts such as a football game.
Figure 4D:
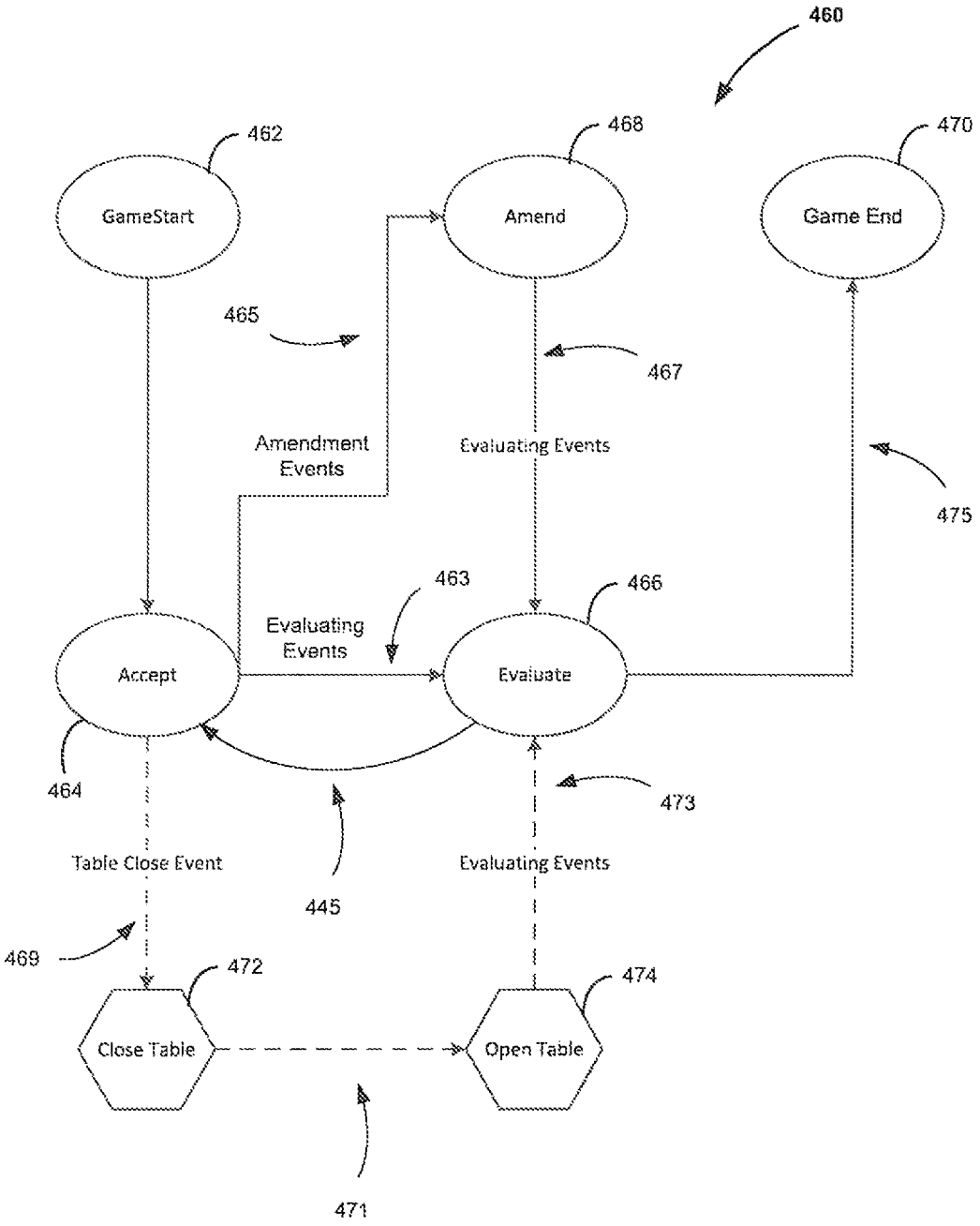
FIG. 4D is an illustration of a general state diagram or flow chart for the Participant Manager resources of an embodiment of the system of the invention.
Figure 4E:
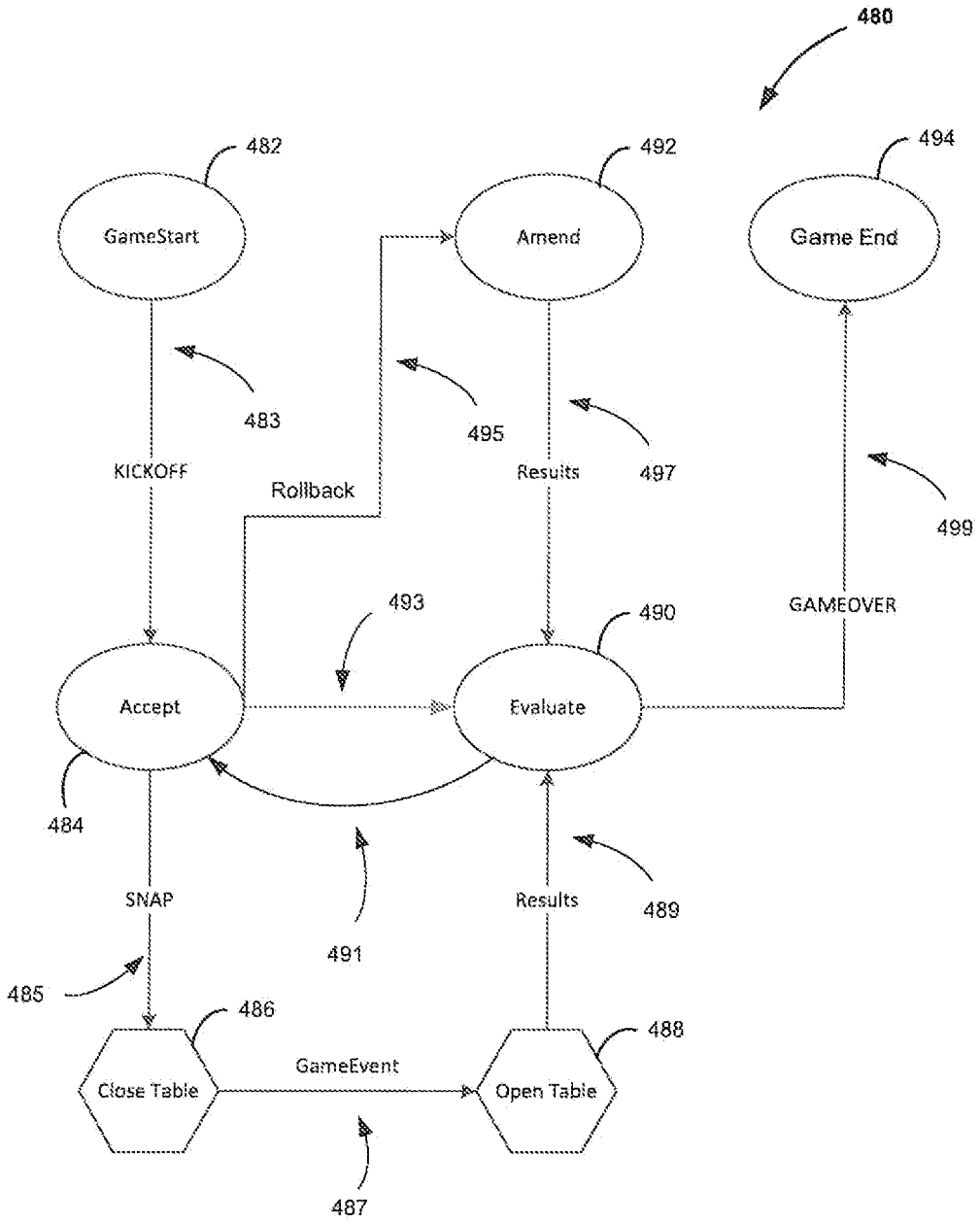
FIG. 4E is an illustration of a state diagram or flow chart for the Participant Manager resources of an embodiment of the system of the invention that is processing wagers on non-continuous action external contexts such as a football game.

FIGS. 4A-4E are hybrid state and flow diagrams that illustrate the general states of the system 100, as well as specific components of the system as wagers are made between user/participants through the respective UI (102, 104, 106). FIG. 4A illustrates a generalized state diagram 400 for the system (100, FIG. 1). State diagram 400 applies to each "table" established for the purposes of facilitating wagering on any one particular "Game" (i.e. external context) between users as participants of that table. The table can be created any time before the conclusion of the "Game," including prior to commencement of the "Game."

After the Game starts at 402, the system 100 is configured to receive proposals and acceptances of proposals, and transitions to the "Accept" state at 404. During this state, the system 100 allows users to submit new proposals and accept proposals. The Participant Manager 116 manages the creation of the closed engagements. The Participant Manager resource 116 broadcasts these engagements as they are created, to a listening Engine 124 resource that queues them for evaluation. The engagements and proposals are also broadcast to the Presentation Manager 112, which generates a visual presentation back to the participants of the table through the UI (102, 104, 106).

System (100, FIG. 1) remains in the "Accept" state as described above until an evaluate trigger is received that transitions the system (100, FIG. 1) to the "Evaluate" state 406 as signified by transition 405. The evaluate trigger can be one of a number of distinct and repeatable events that define the onset of finite plays such as a "snap" in football or a "pitch" in baseball games. For continuous-play types of external contexts such as basketball, soccer and hockey, the Evaluation trigger can be a context action such as a change of possession action or it can also be simply a periodically timed event under the control of the system 100. Once the trigger occurs and the system 100 enters the "Evaluate" state 406, the Engine 124 resource commences an evaluation period by copying all of its currently queued engagements to an evaluation cache. This 'snapshot' of the currently pending engagements are the only engagements that will then be subject to evaluation by the Engine 124 resource during the current evaluation period. While in the Evaluate state, the system still accepts new proposals and creates new engagements, but these are not included in the snapshot and are therefore not subject to evaluation.

While in the Evaluate state, the Engine 124 resource receives GameEvent data for the Game that is broadcast to it from the Event Manager 118 resource. The GameEvents are used to evaluate the engagements in the cached snapshot that are currently capable of being evaluated. The evaluation period ends when all GameEvents pertinent to the current evaluation period have been broadcast by the Event Manager 118 resource. At the conclusion of the evaluation period, the system 100 returns via transition 407 to the Accept state 404.

At the conclusion of the evaluation period, all engagements that were evaluated during the period are deleted from the queue and the results of the evaluation process for each of the evaluated engagements are broadcast back to the Participant Manager 116. The Participant Manager 116 then updates the accounts of the user/participants and broadcasts the results back to them through the Presentation Manager 118 and the UI (102, 104, 106). Any of the cached engagements that were not able to be evaluated during the evaluation period, and for which the time horizon has not expired, are left in the queue for future evaluation along with engagements newly received and queued since the commencement of the evaluation period.

It should also be noted that during the evaluation period, a stream of GameInfo data is also being generated from the GameEvents of the current GameEvent Message to create an update to the status of the game for display to the participants of the table based on the results of the play described by the EventData. This GameInfo is sent to the participants by way of the Presentation Manager and the ultimately through the UI.

The foregoing description thus far applies primarily to the most general case. For continuous action games such as soccer, basketball and hockey, the system 100 continues to accept engagements even during the evaluation period. The Participant Manager 116 can be instructed to hold back broadcast of such new engagements for a predetermined delay or they can be broadcast and queued continuously by the Engine 124 while it is evaluating the set of engagements that were cached upon triggering of the current evaluation period (i.e. transition to the Evaluate state).

For discrete play external contexts such as football and baseball games, it makes more sense to suspend the continued acceptance of new engagements during the evaluation period. In the case of football for example, before the system 100 transitions 405 to the Evaluate 406 state, the trigger condition (i.e. the snap of the ball) causes the system to first transition 411 the table from an open to a closed state at 412. During the closed state 412, no further engagements are accepted and otherwise created by the Participant Manager 116 either by acceptance or match. This prevents, for example, proposals to be accepted regarding whether a play is a pass or a run in the middle of a play, after the ball has already been snapped.

Once GameEvents that make up the GameMessage describing the actions of the current play start to be broadcast from the Event Manager 118 (thereby indicating that the current play has been concluded), the table first transitions 413 back to an "open" state 414 and the system 100 then proceeds to the Evaluate 406 state by transition 409, to cache the snapshot of engagements in the queue to commence the evaluation period. The evaluation period then continues as previously described above in the more general case.

The flow between the Accept state 404 (including the processes of accepting and broadcasting engagements) and the Evaluate state 406 continue until the external context (e.g. the game ends) at Game End 410.

One other system process path occurs in the situation where an error has occurred in the GameEvents messages sent by the Event Manager 118, or when one or more context actions have been reversed and need to be corrected. This exception will result in the creation of a rollback GameEvent Message from the Event Manager 118 which is broadcast to both the Engine 118 and the Participant Manager 116 to identify the one or more EventMessage Session ID's of EventMessages that must be corrected.

This triggers the system 100 into the Rollback/Amend state 408 via transition 403. During this state, the Engine 124 retrieves a copy of the snapshot previously associated with the offending Session ID, and then proceeds to the Evaluate 406 state where it restores the retrieved snapshot of engagements evaluated based on the GameEvents data being corrected, and caches these engagements for re-evaluation based on the corrected GameEvents. The Engine 124 then commences a new evaluation period for the retrieved cache of engagements, and the system moves back to Accept state 404. The Engine 124 receives a new EventMessage from the Event Manager 112 that includes one or more corrected GameEvents with which to evaluate anew the retrieved snapshot of engagements.

The Engine 124 also broadcasts to the Participant Manager 116 the new evaluation results necessary to reverse the results of the prior evaluation and to undo the relevant updates to the user/participant accounts. The new state of the GameInfo is also generated by the Event Manager 118 based on the corrected GameMessage and is then broadcast to the participant/users through the Presentation Manager 112 and the UI (102, 104, 106).

Figure 5:
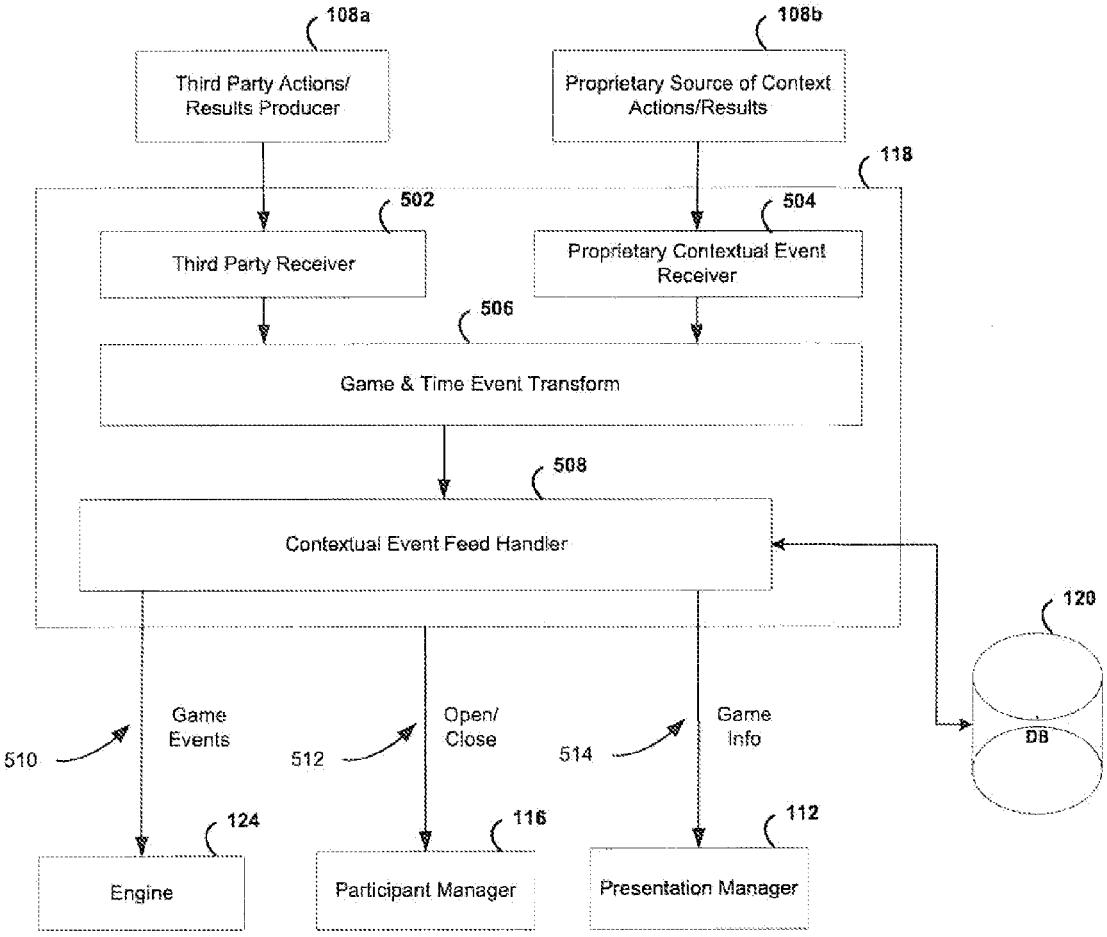
FIG. 5 is a conceptual block-level illustration of the Event Manager resource of the invention as it manages the events of the external contexts.

A more detailed representation of Event Manager 118 and its relationship with other components of system 100 is illustrated in FIG. 5. The Event Manager 118 consumes and transforms external context actions in the form of a data stream from a source of such data. As previously described, the source could be a third party source 108*a* of such data such as stats.com or a news feed; this would be received by a Third Party Receiver 502, which would pass the data along to the Game & Time Event Transform module 506. Alternatively, the source could be a proprietary source (e.g. manually entered data) of such information 108*b*; these data would be received by a Proprietary Contextual Event Receiver 504, which would pass the data along to the Game & Time Event Transform module 506. All actions from external contexts are extracted from the data stream for each external context and transformed by producer specific adapters (generalized in this figure as 506) to a standardized format that will be processed by the system 100. The extracted actions are then published to Feed Handler 508 which manages subscriptions and snapshots from the Engine 124 (for evaluation and life-cycling purposes), the Participant Manager 116 and the Presentation Manager 112 for information. The Feed Handler 508 also persists the Event Data for historical snapshot requests 120. This is useful for both end user research and for Engine amendment or rollback evaluations.

Context data consumers request such data either by subscription or snapshot. Each request can be accompanied by request criteria or filters. Context data subscriptions are provided based on certain criteria. For an external context subscription, which is the highest level subscription, all actions derived from a given external context are provided to that subscriber. For event horizon subscriptions, the data can be filtered by the type of event horizon and only actions that act upon specified horizons will be provided. For action subscriptions, data can be filtered by a specified set of one or more actions that the subscriber is interested in. Snapshots can be requested across additional criteria such as external contexts spanning all of "American Football" or all "1:00 PM Games."

Figure 7A:
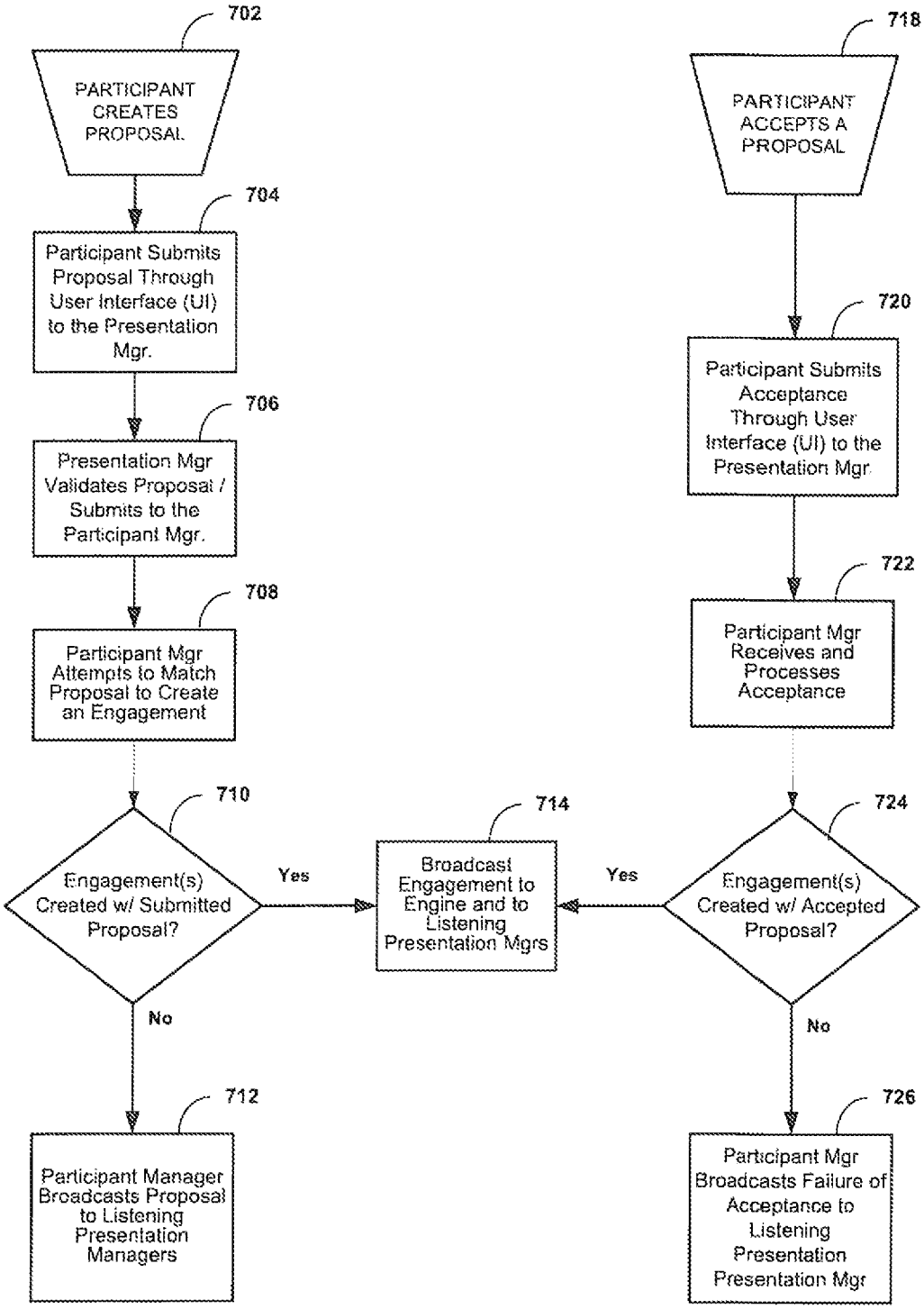
FIG. 7A is a flow chart of the system of the invention by which proposals and acceptances are processed by the Participant Manager resource of the invention.

FIG. 7A illustrates a procedural flow diagram describing the process by which proposals and acceptances are handled by the Participant Manager 116. At 702, a participant creates a proposal through the UI screens described above, that are being displayed by a browser or an installed client on a user terminal such as a computer, tablet, PDA or cell phone (not shown). At 704, the participating user submits the proposal to the Presentation Manager 112 through a UI 102, 104, 106 that is appropriate to the type of user terminal used. The proposal data is transmitted to the Presentation Manager 112 over a network interface (e.g. 103, 105, 107) and then over a network such as the Internet 110 for example.

At block 706, the proposal is validated as to proper format and is then sent to the Participant Manager 116. At processing step 708, the Participant Manager 112 tries to match the proposal with other proposals already submitted to create an engagement. As previously discussed, this is a situation where two participants are proposing wagers that can be matched to provide an engagement based on the fact they are essentially specifying external event conditions and event horizons that amount to a proposal and an acceptance of each others' proposals.

At 710, if an engagement can be created by a match between proposals, the processing continues at 714, were the engagement is then broadcast to listening Engine Resources 116 and Presentation Managers 112. As previously discussed, the various resources that are dedicated to processing any particular engagement are listening by subscription for their engagements. The Presentation Manager will communicate to the two participants that they now have a closed engagement between them. Likewise, the engine resource that has subscribed to engagements from the particular table in which the engagement was just created will receive the engagement for future evaluation.

If no engagement could be created by matching the proposal at decision block 710, processing continues at block 712, where the proposal is broadcast to all listening presentation manager resources (i.e. Presentation Manager resources dedicated to servicing participants that are participating as part of the table at which the proposal was created) so that the participants of the table are aware that the proposal has been created and can be accepted.

At block 718, a participant of the table may accept the proposal broadcast at block 712 above, or any other open proposal previously proffered by other participants of the table. An acceptance is submitted to the participant's presentation manager resource at 720 through the UI. At block 722, the Participation Manager receives the acceptance and attempts to match it with the accepted proposal. If the engagement can be created at block 724, processing moves to block 714 where the engagement is broadcast to listening engine and presentation manager resources. If the engagement cannot be created at block 724, because for example, the accepted proposal was already matched with or accepted by another participant, processing moves to block 726 where the failure of the acceptance is broadcast to the listening presentation manager by which to notify the participant.

Figure 7B:
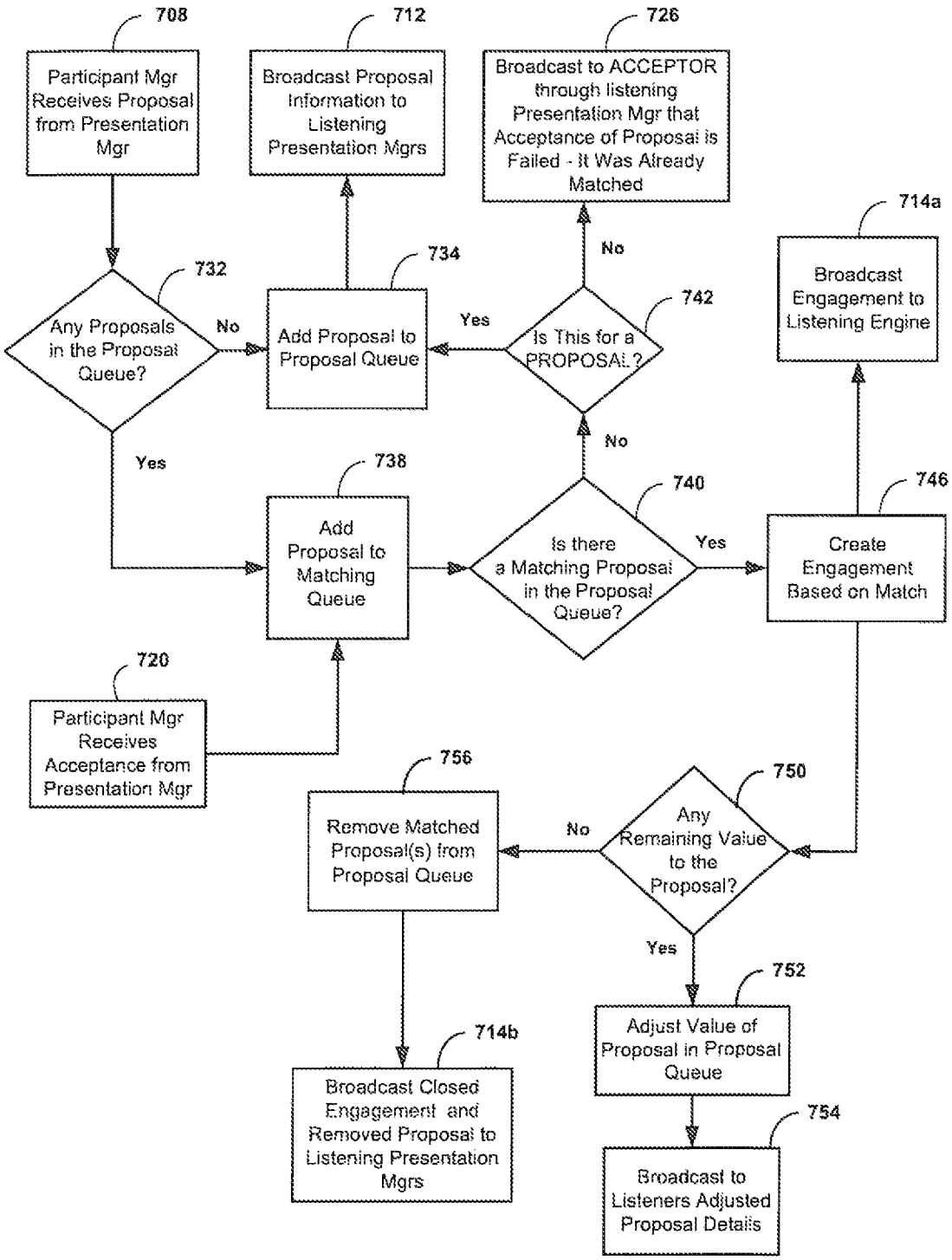
FIG. 7B is a more detailed flow chart of FIG. 7A by which proposals and acceptances are matched by the Participant Manager resource of the invention to form engagements.

FIG. 7B presents a more detailed procedural flow for the processing of the proposals and creation of engagements by the participant manager, and more specifically how the functions of decision blocks 710 and 724 are performed. At block 708, proposals arrive from the Presentation Manager. At decision block 732, it is determined first if there are any other proposals already in a Proposal Queue maintained by the Participant Manager. If the answer is no, the proposal is simply added to the Proposal Queue at 734, and the unmatched proposal is broadcast to the listening Presentation Managers at block 712. If the answer at decision block 732 is yes, that there are already other proposals in the Proposal Queue, then at block 738 the proposal is queued in the Matching Queue for possible matching with the other proposals already in the Proposal Queue. Likewise, acceptances are received by the Presentation Manager at processing block 720 The received acceptances are then queued for matching along with incoming proposals at block 738.

At decision block 740, each of the received proposals and acceptances in the Matching Queue are then compared, in the order in which they are received, to the proposals already in the Proposal Queue to identify any matches that may exist. For any matches identified at block 740, engagements are created at block 746 and the created engagements are broadcast to the listening engine and presentation manager resources at the block 714. If no matches are identified at decision block 740, all proposals that were placed in the Matching Queue at decision block 742 and they are then placed into the Proposal Queue at block 734. All of the newly added proposals are then broadcast to listening Presentation Managers at block 712. All acceptances are also identified at decision block 742, which result in the answer to "NO" to the question of "Was this a Proposal?" (If it is not a proposal, then it is an acceptance). All acceptances that were not matched are thus processed at block 726, where the fact that an acceptance submitted by a participant failed to establish an engagement. This is usually because the proposal had already been matched and thus could no longer be accepted.

Returning to decision block 740, if one or more matches occurs, and thus the answer at 740 is yes, processing moves to block 746 at which engagements are created for all proposals or acceptances that were found to have a match with a proposal in the proposal queue. All created engagements are then broadcast to listening engine and presentation manager resources at processing block 714*a*. From block 746, processing also branches to decision block 750, at which point it is determined if any of the engagements were created that involved an acceptance or match at less than the full value of the proposal matched from the Proposal Queue. If the answer is "NO," processing continues at processing block 756, where all matched proposals are removed from the Proposal Queue. The fact that an engagement was created, and that the proposal has been removed from the Proposal Queue is broadcast to the listening presentation managers at processing block 714*b*.

Figure 7C:
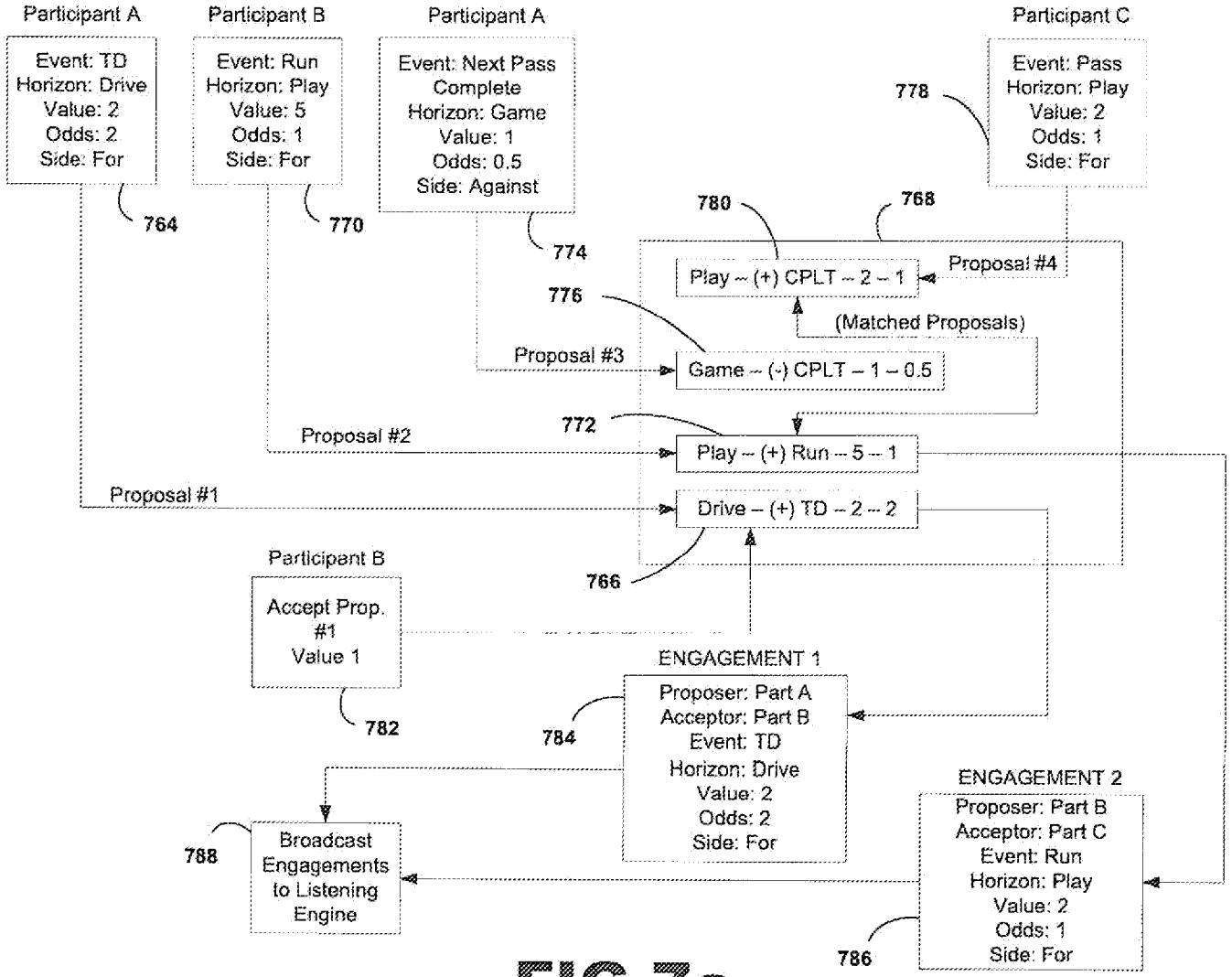
FIG. 7C is conceptual block-level illustration of a Participant Manager resource of the invention as it manages specific examples of various proposals and acceptances made by participants for a football game.

If the answer to the question posed by decision block 750 is "YES," it means that there is some remaining value to the proposal matched from the Proposal Queue at block 740. Processing would then continue for such a match at block 752, where a new proposal is created for the remaining unaccepted value of the original proposal, and that remainder proposal is left in the Proposal Queue with its altered value. The adjusted proposal is then broadcast to listening presentation manager resources at block 754 so that participants at the table are aware that some of the value of the original proposal remains and can still be accepted FIG. 7C conceptually illustrates the proposal queue 768 of the participant Manager 116 for participants that are viewing a football game as an external context. As illustrated, Participant A creates and submits Proposal #1 764, which specifies that a Touchdown (TD) will be scored during the current drive, and gives it a value of 2 with odds of 2 to 1 that it will happen. If there are any other proposals already in proposal queue 768, proposal 764 is first compared with those other proposals to determine if there is a match between any of them. In the example, there is not, so Proposal #1 764 is then stored in the proposal queue 768 as entry 766. Entry 766 has a first field that defines the event horizon of the Proposal #1 764 (i.e. DRIVE), a second field that indicates if the proposal is for (+) or against (−) the action taking place within the event horizon, a third field that defines the action that will or will not take place within the event horizon (i.e. TD), a fourth field that defines the value ascribed to the proposal and a fifth field that indicates a multiplier that modifies the value of the proposal to the proposer if the conditions as of the proposal are met.

Participant B creates and submits a Proposal #2 770 that the next play will be a running play, with a value of 5 and even odds. This proposal is likewise first checked against Proposal #1 764 to determine if they are a match, and because they are not, it is stored as entry 772 in proposal queue 768. Participant A further submits Proposal #3 774, that proposes that the next pass thrown will be NOT be a completion (i.e. that it will be an incomplete pass). The assigned value of the Proposal #3 774 is 1 and the odds modifier is 0.5, indicating that the value is worth less than full value to the proposer if the conditions are met. Once again, this Proposal #3 774 is compared to the Proposal #1 764, and #2 770 already in the proposal queue 768, and because there is no match, Proposal#3 774 is stored as entry 776 therein.

Participant C then creates and submits a Proposal #4 778 that proposes the next play will be a pass play, for a value of 2 and even odds (i.e. the odds modifier is 1). The Proposal #4 778 is compared to the other proposal entries in the queue 768, and a match is identified between Proposal #4 778 and Proposal #2 770 stored as entry 772 and previously submitted by Participant B. The reason they match is that Participant B is betting that the next play will be a run, and Participant C is betting that the next play will be a pass. In this case, the event horizon is defined as the next play from scrimmage, so a punt or kicking play will not result in an evaluation of the engagement.

As a result of the match, Engagement #1 784 is created from the match between the proposals of Participants B and C. Because the values do not match, the value of the created Engagement #1 784 has a value equal to the lower of the two values which is 2. This is essentially as if Participant C had accepted Participant B's proposal 770, but for only a fraction of the proposal's total value. Because not all of the value of Participant B's Proposal #2 770 has been accepted, the Participant Manager 116 modifies the "value" of field of entry 772 to reflect the remaining value of 3, thereby creating a remainder proposal having the same conditions but a value of 3. This adjustment to the proposal is then broadcast to the listening Presentation Managers as illustrated by block 786. The created Engagement #2 784 is broadcast both to listening engine resources as well as to listening Presentation Manager resources. It should be noted that had Proposal #2 770 been accepted for its full value of 5, entry 772 of proposal queue 768 would have been cleared and the fact that Proposal #2 770 had been accepted/matched would be broadcast to the listening Presentation Manager resources as well.

Finally, Participant B creates and submits an Acceptance 780 of Participant A's Proposal #1 764, and the full value of 2 has been accepted. Because Proposal #1 764 was still pending in the proposal queue 768, an Engagement #2 782 is created and entry 766 is cleared. The Engagement #2 782 is then broadcast to listening engine and presentation manager resources, and the fact that Proposal #1 764 is no longer pending is broadcast to the listening Presentation Manager resources, as shown by block 786.

Figure 6:
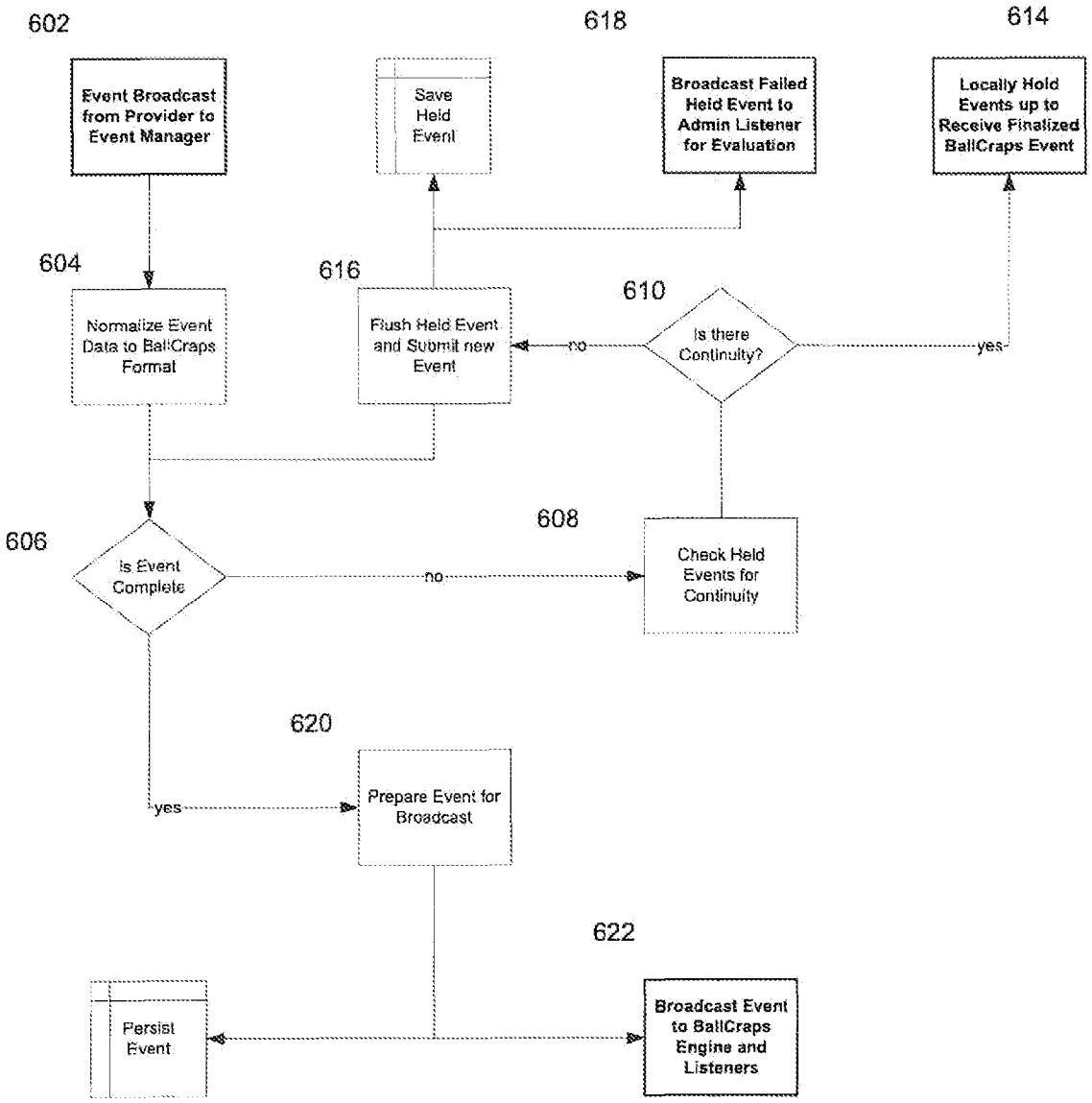
FIG. 6 is a detailed flow chart of the invention by which context event and results data are processed by the Event Manager resource of the invention.

FIG. 6 illustrates the process flow performed by the Event Manager 118. At block 602, the Event Manager 118 receives a broadcast from the External Context Action Provider 108 that includes a description of actions that have just taken place during an external context. The description of the actions might be textual, or it may be formatted that parses the information by into fields in accordance with categories of such information. These descriptions may be provided by a third-party vendor or otherwise entered manually by an authorized user. At block 604, the action data is normalized into a format that permits processing of the information by the system of the invention. As previously discussed, the data is typically parsed into distinct frames of data that contain fields assigned to contain for example, an action (e.g. run, pass, TD, goal, etc.), a modifier of the actions (e.g. yardage gained by run or pass, 2 or 3 points for a basketball field-goal, yardage on a fumble return, which base was stolen, the players involved in the play, etc.).

At decision block 606, it is determined if the current frame represents an end to a complete context transaction. A context transaction is simply a way of defining a finite group of related context actions that are part of a continuous flow of actions of the external context. For football, a play is a convenient parsing of the action which starts at the snap of the football and then ends when the whistle is blown by the officials to signify the end of the play. Any given play can be sequence of actions that might start with a pass, followed by a catch and then a run-after-the-catch, whereupon the receiver can be hit and fumble, which can be recovered by the opposing team, with the fumble recovery itself being run back or a number of yards, resulting in a touchdown. In baseball, a context transaction could start with a pitch, that is put into play the batter, which can result in a base hit, causes a first runner to score, that leads to throw at the plate, that leads to a put out of a second runner, which can lead to the end of the inning.

If the answer at 606 is "NO," the Event Manager 118 checks at block 608 to see if there is appropriate continuity between the most recent frame of data and any other frames of data that are being held as part of the current context transaction. If for example, if two previous frames received as a part of a single transaction indicated that the home team threw a pass and completed it for 26 yards and a first down, but the current frame suddenly indicates the visiting team just ran the ball for 2 yards, there is a clear break in continuity between the first two held frames and the current frame. If there is continuity as determined at decision block 610, processing continues at block 614 where the current frame is queued with any other previously held frames for the current context transaction. However, if the determination at decision block 606 is "YES," the queued frames composing the complete context transactions (as queued by block 614) are prepared for broadcast at block 620 and then broadcast to the listening Engine and Participant Manager resources at block 622.

If the answer is "NO" at decision block 610 indicating a lack of continuity between the held frames of the current context transaction and the current frame received, all of the held frames of the current context transaction along with the current frame are flushed at block 616 and the failure of the current context transaction is broadcast to at block 618 to inform of the failure. At this point, an administrative user would need to address the data feed issue. Furthermore, the current frame that broke continuity is queued as the first frame in the next context transaction.

Figure 8:
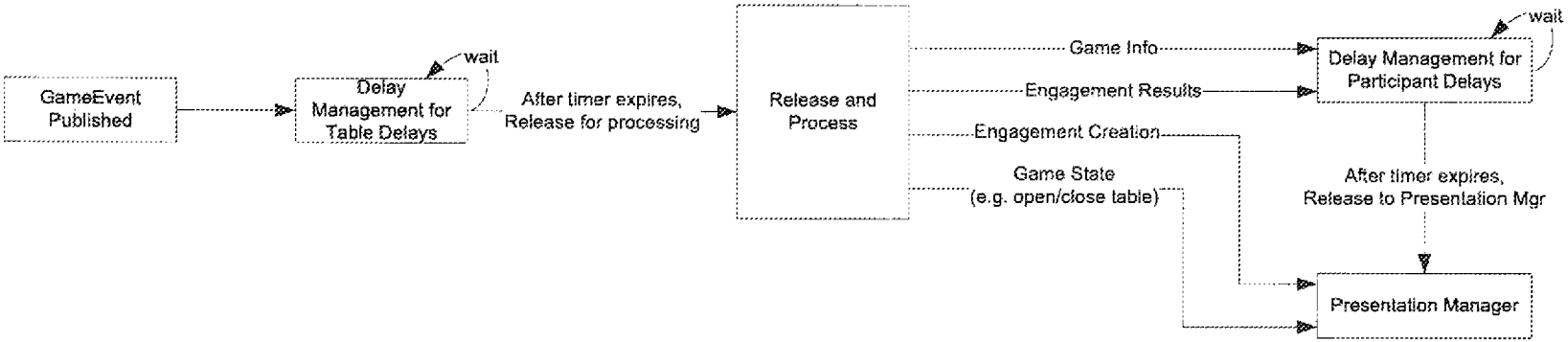
FIG. 8 is an illustration of the Delay of GameEvents and engagement management.

FIG. 8 illustrates how the system 100 manages the requisite delays for the Table and the Participant. If a table delay is specified, the Participant Manager, 116, intercepts GameEvents published by the External Context Provider, 108, to apply the delay. As stated earlier, a table delay may be useful for a private table where all participants are known to be viewing a feed with the same latency.

After the Table Delay Management module's timer expires, the gameEvent is released for processing. The Participant Manager 116 then processes as normal the Game State and Engagement creation, which are broadcast to the Presentation Manager 118. However, should a user choose to further delay the display of the Game Info, the Participant Delay Management module holds the Game Info and Engagement Results until the timer expires, after which they are dispatched and broadcast to the Presentation Manager. In this way, a participant can further delay his view of the external context, in order not to "spoil" the game while watching it.

Both the Table Delay Management module and the Participant Delay Management module follow the same Delay Management workflow. Events are queued as they arrive in the module, each with a style (table or participant) and a time. The system sets a Timer for each queued event, when that Timer fires, the event is then released for processing.

In addition to any previously indicated modification, numerous other variations and alternative arrangements may be devised by those skilled in the art without departing from the spirit and scope of this description, and appended claims are intended to cover such modifications and arrangements.

What is claimed is:

1. A wagering system for receiving a plurality of wagers from a plurality of participants related to a specific game, the game including a plurality of events, each wager defining an engagement between at least two participants dependent on an outcome of one or more events, the system comprising:

a participant manager module adapted to monitor activities of all participants and engagements associated with said specific game, said participant manager including an input receiving an input from a participant representing a proposal for a wager associated with an event of a game;

an event manager module adapted to monitor all the events associated with the specific game and providing alert signals indicative of at least one of the beginning of each event, the end of each event and actions related to associated with each game;

a presentation manager interfacing with participant, said participant interface module receiving commands from participants describing a particular proposal regarding events, each proposal including information describing the game of interest to the respective participant and wager being offered the respective participant for said particular event, said presentation manager presenting each proposal from each participant to the event manager as said inputs from participants, said presentation manager further providing participants with presentations indicative of specific games together with the respective events forming or being associated with each game and wagers from all participants as represented by orders from the respective participants, said orders being indicative of wagering information associated with the events, commands from the participant being associated with respective engagements between participants and providing information indicative of participants engagements to said participant manager; and a game engine associated with said participant manager and said events manager and generating current wagering information reflecting wagers made by participants and wagers won and lost by participants, said game engine further running each specific game together with each of the events of the specific games in progress.

2. The system of claim 1 further comprising provider interface coupled to said event manager, said event manager managing events based on information associated with said events from an external event information provider.

3. The system of claim 1 wherein said participant interface module is adapted to define engagements between participants.

4. The system of claim 3 wherein said participant interface module is adapted to provide a presentation to a first participant, said presentation including a plurality of actual and potential events associated with said specific game and receive a wager command from the participant regarding one of said real and said potential event.

5. The system of claim 4 wherein said participant interface module is further adapted to find another participant accepting said wager from said first participant, said participant interface module defining an engagement between said first and said another participant.

6. The system of claim 5 wherein said participant interface module is adapted to define said engagement prior to said event.

7. The system of claim 5 wherein said participant interface module is adapted to define an engagement during said event.

8. The system of claim 1 wherein said participant interface module is adapted to define tables, each table including at least two participants based on a common engagement.

9. A method of making wagers on a game by a plurality of participants using an automated wagering system, wherein said game has a game beginning and a game end and consists of a plurality of events occurring between said game beginning and game end, said automated wagering system including a presentation manager receiving commands from participants, each command representing an order, a participant manager, an event manager and a game engine said method comprising the steps of:

making presentations by said presentation manager during a game to participants regarding each game, said presentation manager further presenting information to participant about wagering associated with events forming said game;

receiving by said presentation manager a command from a participant and transmitting a communication to the participant manager representative of said command, said command representing a proposed wager by a respective participant;

receiving by said participant manager said communication and generating orders based on commands from participant, said order representing a wager from at least one participant based on an outcome of one event;

finding by said participant manager another participant interested in said wager;

establishing an engagement by said participant manager between said one and said another participant based on said event;

running said game by said game engine, said running including enabling each event in sequence defining said game;

providing interim presentations by said presentation engine to the participant showing ongoing events associated with said game;

collecting by said participant manager current orders while the game is progressing determining by said game engine outcomes of engagements between participants based on respective event;

receiving an outcomes of engagements by said presentation manager;

determining the outcome of wagers based on said engagements by said presentation manager; and presenting said results to the participants and the participant manager.

10. The method of claim 9 wherein said system includes a monitoring module monitoring said event, wherein said determining is made based on an output of said monitoring module.

11. The method of claim 9 wherein said system includes an external interface receiving external information descriptive of said event including said outcome, wherein said determining is performed based on said external information.

12. The method of claim 9 wherein said game is partitioned into several gaming periods and wherein said event corresponds to one of said gaming periods.

13. The method of claim 9 wherein said step of establishing occurs in real time during said game.

14. The method of claim 9 wherein said step of establishing occurs the respective event has been completed, wherein said steps of making said presentations, is delayed by a predetermined period.

15. The method of claim 9 further comprising determining a further result for said event that supersedes said result, and rolling back information said engagement based on said further results.

16. The method of claim 9 receiving an acceptance of a proposal by one of the participants before establishing the engagement.

17. The method of claim 9 further comprising establishing the engagement based on a set of predetermined rules.

18. The method of claim 9 further comprising delaying said event for a plurality of participants, whereby wagering occurs after the beginning of the event.

19. The method of claim 9 further comprising generating said proposals based on a set of predetermined rules.

20. The method of claim 19 wherein at least some of said predetermined rules are dependent on a plurality of interlocking and inter-related events.

* * * * *